US006637178B1

(12) United States Patent
Cook et al.

(10) Patent No.: US 6,637,178 B1
(45) Date of Patent: Oct. 28, 2003

(54) BAGGER METHOD AND APPARATUS

(75) Inventors: Steven T. Cook, Bellbrook, OH (US); Brian W. Clark, Lewisburg, OH (US); Steffen W. Kracis, Dayton, OH (US); Dennis F. Moore, Jr., Beavercreek, OH (US); William E. Schneberger, West Carrollton, OH (US); Timothy A. Whitehead, Dayton, OH (US)

(73) Assignee: Dayton Systems Group, Inc., Miamisburg, OH (US)

( * ) Notice: Subject to any disclaimer, the term of this patent is extended or adjusted under 35 U.S.C. 154(b) by 0 days.

(21) Appl. No.: 09/509,413

(22) PCT Filed: Sep. 30, 1998

(86) PCT No.: PCT/US98/20395

§ 371 (c)(1),
(2), (4) Date: Mar. 27, 2000

(87) PCT Pub. No.: WO99/16670

PCT Pub. Date: Apr. 8, 1999

Related U.S. Application Data

(60) Provisional application No. 60/060,518, filed on Sep. 30, 1997.

(51) Int. Cl.[7] ..... B65B 35/40; B65B 35/50; B65B 5/06

(52) U.S. Cl. ..... 53/447; 53/469; 53/481; 53/532; 53/542; 53/284.7; 53/375.6; 53/254; 53/570

(58) Field of Search ..... 53/447, 469, 481, 53/532, 284.7, 375.6, 254, 459, 482, 542, 570, 247

(56) References Cited

U.S. PATENT DOCUMENTS 3,337,064 A 8/1967 Mojden et al.
3,417,853 A 12/1968 Mojden et al.
3,545,631 A 12/1970 Mojden et al.
3,618,530 A 11/1971 Swartz
3,722,741 A 3/1973 Mojden
3,878,945 A 4/1975 Mojden et al.
3,971,189 A * 7/1976 Mojden et al. ..... 53/254 X
4,000,709 A 1/1977 Mojden
4,364,255 A 12/1982 Byrd
4,537,010 A 8/1985 Mojden et al.
4,537,550 A 8/1985 Mojden et al.
4,655,350 A 4/1987 Mojden et al.
4,676,708 A 6/1987 Mojden et al.
4,742,669 A 5/1988 Mojden
5,005,340 A 4/1991 Mojden
5,119,617 A * 6/1992 Mojden et al. ..... 53/542 X
5,175,980 A * 1/1993 Chiappe et al. ..... 53/542 X
5,180,277 A * 1/1993 Pearce et al. ..... 53/254 X
5,335,810 A 8/1994 Halloway (List continued on next page.)

*Primary Examiner*—Stephen F. Gerrity
(74) *Attorney, Agent, or Firm*—Fay, Sharpe, Fagan, Minnich & McKee, LLP

(57) ABSTRACT

An improved can end bagging system comprises four subassemblies: (1) the end gathering and stick assembly apparatus, (2) the bag feeding, opening, and loading apparatus which places a predetermined number of stacked can ends into an open end bag, (3) the vertical positioner apparatus for moving the bagged sticks into a folding device, and (4) the bag folding, closing and transfer apparatus. The loading mechanism includes a servo controlled pusher which is driven with controlled acceleration and deceleration to avoid tipping of the ends making up a stick, to avoid bursting of the bags during filling, and to assure complete and uniform filling of each bag. Sponginess which results primarily from variations in compression of the rims of the ends pressing against each other in the gathering and counting process is avoided. Once the closed stick is sealed, it is prepared for transfer into a gathering mechanism in a palletizer, maintaining a predetermined orientation of the bag, while a desired number of bags are assembled for making up horizontal rows on a pallet.

12 Claims, 30 Drawing Sheets

U.S. PATENT DOCUMENTS 5,372,245 A 12/1994 Mojden et al.
5,372,473 A 12/1994 Moyden et al.
5,408,090 A * 4/1995 Craddock
5,410,859 A * 5/1995 Kresak et al. ..... 53/247 X
5,419,099 A * 5/1995 Mueller et al. ..... 53/485
5,524,947 A 6/1996 Mojden et al.

* cited by examiner

BAGGER METHOD AND APPARATUS

Related Applications

Th This application claims priority from PCT/US98/20409, filed Sept. 30, 1998, which claims priority from U.S. Provisional Patent Application Ser. No. 60/060,518 filed Sept. 30, 1997.

TECHNICAL FIELD

This invention relates to methods and apparatus for packaging can ends, e.g. disc-like end units which have a preparatory curl on their edge and which may also have attached easy-open tabs. In practice such apparatus is often called a bagger, since the preferred manner of packaging the ends places a stack (usually called a "stick") of the ends in a tubular bag which is then folded closed at its initially open end.

BACKGROUND ART

In the early 1970s can ends were placed manually into bags, and the bags were loaded manually into pallet for use at filing/closing machinery. In the mid-1970s semi-automatic bagging equipment was introduced in an effort to keep up with the increased output of newer conversion presses, and that development led to automatic bagging machines, which were first introduced in the mid-1980s. Some of the impetus for this development was the monotony of repeated manual operations, which also appeared to be the cause of repeated strain to the hands of those doing the bagging.

Those automatic machines formed a "stick" of ends and then packaged them 1) by wrapping them from a coil or reel of paper or plastic, or 2) placing the sticks into preformed bags. It was found that kraft paper was the preferred wrapping material since it can be recycled, and since it will "breathe" to void fumes which may linger with the stick of ends from synthetic sealing compounds applied to the ends in an earlier operation, or to void moisture which may linger from water based compounds.

In the early patent prior art, the disclosures in U.S. Pat. Nos 3,337,064, 3,417,853, 3,545,631 and 3,618,530 are representative of systems which use a pneumatic or similar input conveying system for the individual can ends, and troughs or the like for gathering the ends in a face to face on-edge stack. Mechanical feeding mechanisms engage the curl edges of the generally vertically positioned ends and move them into the input or receiving end of a stack forming in a trough, then the ends are supplied to a filling and closing (end curling) machine. Wrapping a stack is not disclosed, and the filled trough is intended to function as a reservoir for smooth steady supply of ends to the closing machine.

In U.S. Pat. Nos. 3,722,741, 4,000,709, 4,537,550, 4,676,708 and 5,335,810 more sophisticated buffer systems for stacks of ends are disclosed, wherein the stacks are separated according to a count of stacked ends, and those stacks are loaded into successive vertically arranged carriers on an endless, carrousel-type conveyor which supplies the stacks to a closing machine.

U.S. Pat. No. 3,878,945, and its various divisions Nos. 3,962,845, 3,971,189, 4,051,965, and U.S. Pat. No. 5,119,617, all disclose features of an automatic bagging system in which ends are supplied to a gathering and counting deice which separates ends into stacks (or "sticks"), wrapping devices for loading the stacks into individual bags, and mechanism for loading the wrapped stacks onto pallets.

U.S. Pat. No. 4,364,255 relates to a conveying improvement for gathering ends, providing temporary spacing thereof to facilitate curing of previously applied end seam compound. U.S. Pat. No. 4,655,350 discloses an improvement for detecting and removing ends which have been reversed factoback (e.g. public to product sides) in the formation of a stack. U.S. Pat. No. 4,742,669 discloses an improved end counting device in the end counting and stack forming systems. U.S. Pat. No. 5,005,340 discloses a system for inspecting an assembled stack of ends. U.S. Pat. No. 5,372,245 discloses an improved drive for an in-feeding array of assembled ends. U.S. Pat. No. 5,524,947 discloses an improved mechanism for picking and placing stacks (also called "sticks") of ends in the bagging and palletizing process.

U.S. Pat. Nos. 4,537,010 and 5,372,473 disclose more advanced devices for handling bagged stacks of ends and placing them into pallets.

Thus, prior art automatic bagging machines allow lanes of ends from the output of a conversion press to be counted, separated in stacks or sticks, the stacks placed into individual bags, and the bagged stacks are then loaded into a common palletizer, from which a supply is provided Go one or more filling and closing devices.

SUMMARY OF THE INVENTION

According to this invention each stick of ends contains an exact count of ends which are separated from the incoming stream of ends, and that dimension, as well as the orientation of the stick, is maintained through processing in the novel automatic bagger provided by the invention. The loading operation, moving the stick of ends into an open ended bag, is controlled such that sponginess of the assembled stick is taken into account, and the bags will not be overfilled. On the other hand, under filled bags will be rejected. The sponginess results primarily from variations in compression of the curl ends (rims) of the ends pressing against each other in the gathering and counting process.

The loader mechanism includes a servo controlled pusher which is driven with controlled acceleration and deceleration to avoid bursting of the bags during filing, while assuring complete and uniform filling of each bag.

An improved can end bagging system according to the invention comprises four subassemblies or subsystems, 1) the end gathering and stick assembly (or formation) apparatus, 2) the bag feeding, opening, and loading apparatus which places a predetermined number (to comprise a complete stick) of stacked can ends into an open end bag, 3) the vertical positioner apparatus for moving the bagged sticks into a folding device, and 4) the bag folding, closing and transfer apparatus.

Once the closed stick is sealed, it is transferred into a gathering mechanism in the palletizer section of the system, maintaining a predetermined orientation of the bag, until a desired number of bags are assembled on a transport carrier tray. That number of bags is determined by the number of bags desired as making up a horizontal row on a pallet load of the bags.

A palletizing mechanism supplies a pallet (support) and a length of wrapping paper (usually Kraft paper or the like) for receiving successive rows of bags and intertwining rows until a full pallet load is prepared. Details of this operation are disclosed in copending International Application No. PCT/US98/20409.

DETAILED DESCRIPTION

BEST MODE FOR CARRYING OUT THE INVENTION

The present invention is directed to an improved bagger apparatus which is part of a bagger/palletizer system.

To understand the following description, it is desirable to include first definitions of certain terms, as follows:

A "Stick" is an assembly of a predetermined number of can ends or lids or a bag filled with such assembled ends;

A "Skid" refers to the wooden structure on which a pallet of sticks is built; filled pallets are formed in the palletizer apparatus, details of which are disclosed in the related International Application No. PCT/US98/20409 (WO 99/16672).

The "Interface Panel" (not shown) is the operator interface of a commercially available programmable controller for the automatic bagger system; a typical such controller is available from Allen-Bradley; "Bagger" refers to the portion of the system that forms the sticks by counting ends from the lead (foremost) end in a stream of can ends which are supplied to the bagger apparatus along in-feed rails, the ends being placed on edge and moving face-to-face along such rails; The bagger counts a predetermined number of ends, separates them from the following stream, and places them into a bag, then folds and seals the bag.

Figure 1:
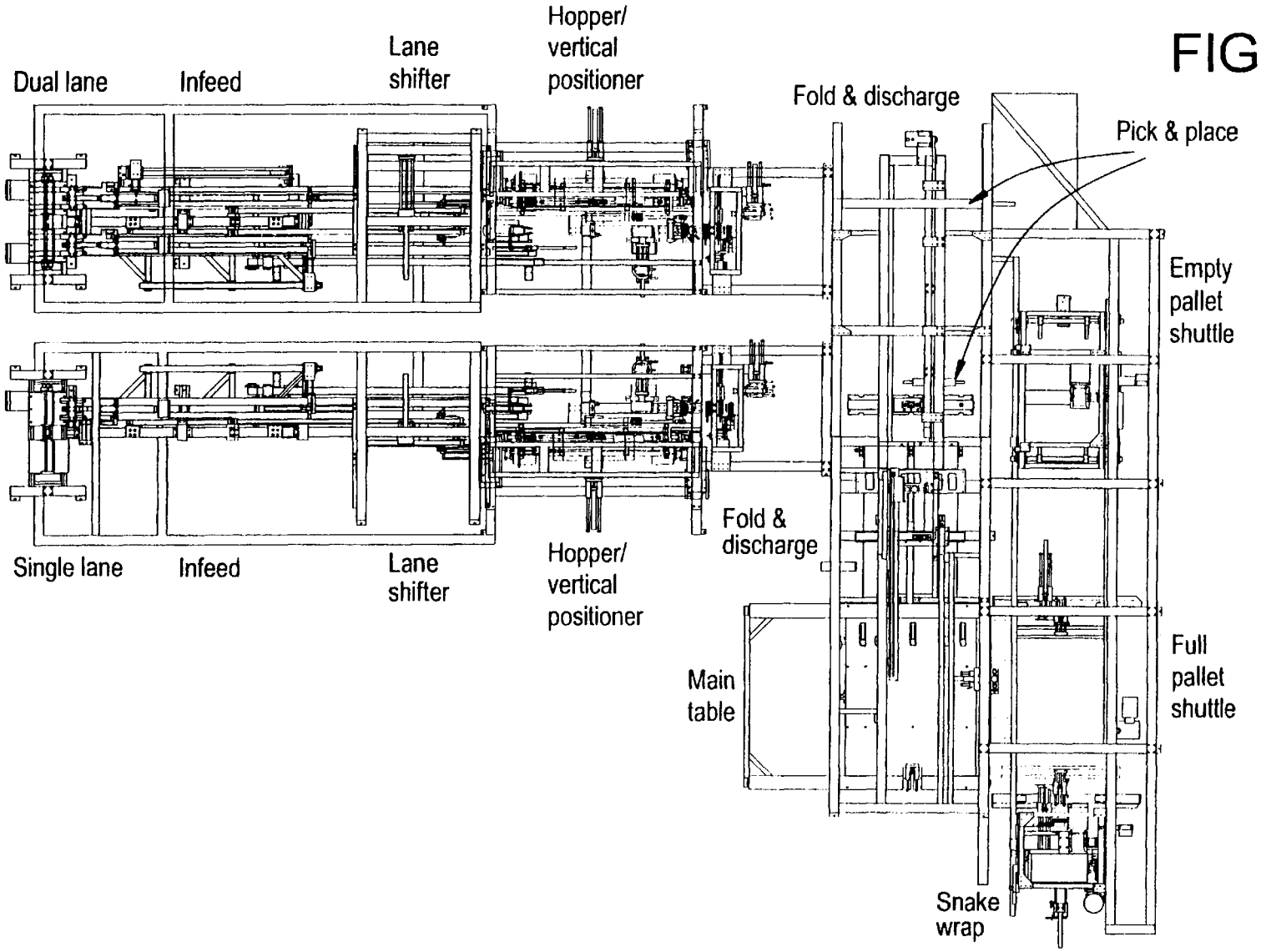
FIG. 1 is a schematic plan view of the major components of the complete system.
Figure 2:
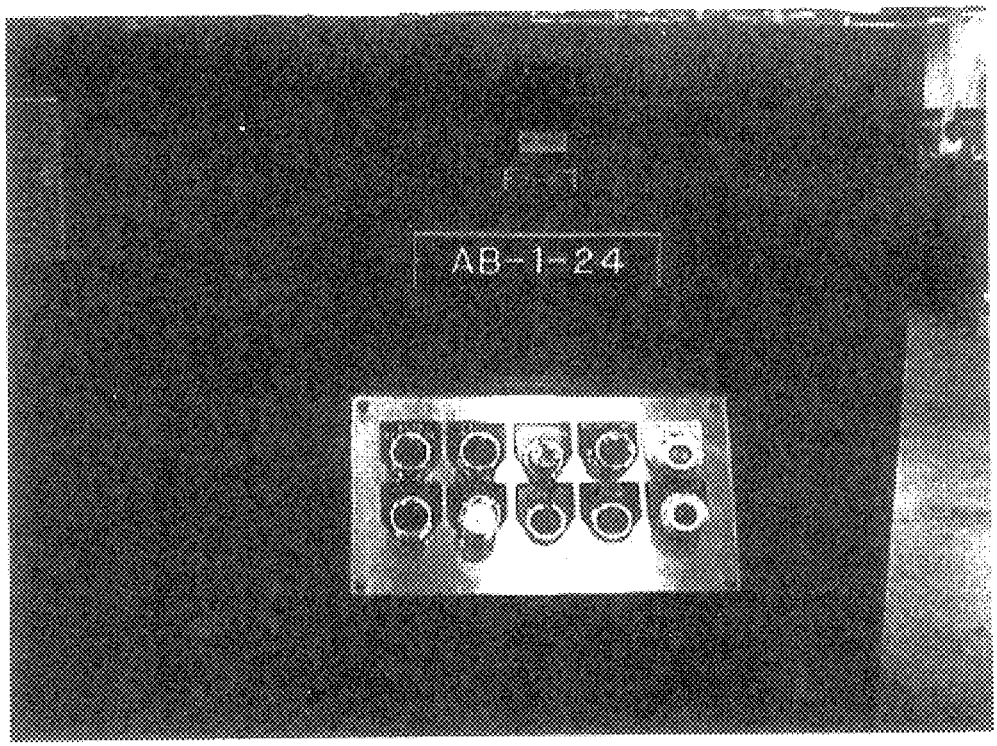
FIGS. 2 and 3 are frontal views of the two bagger electrical operator panels.
Figure 3:
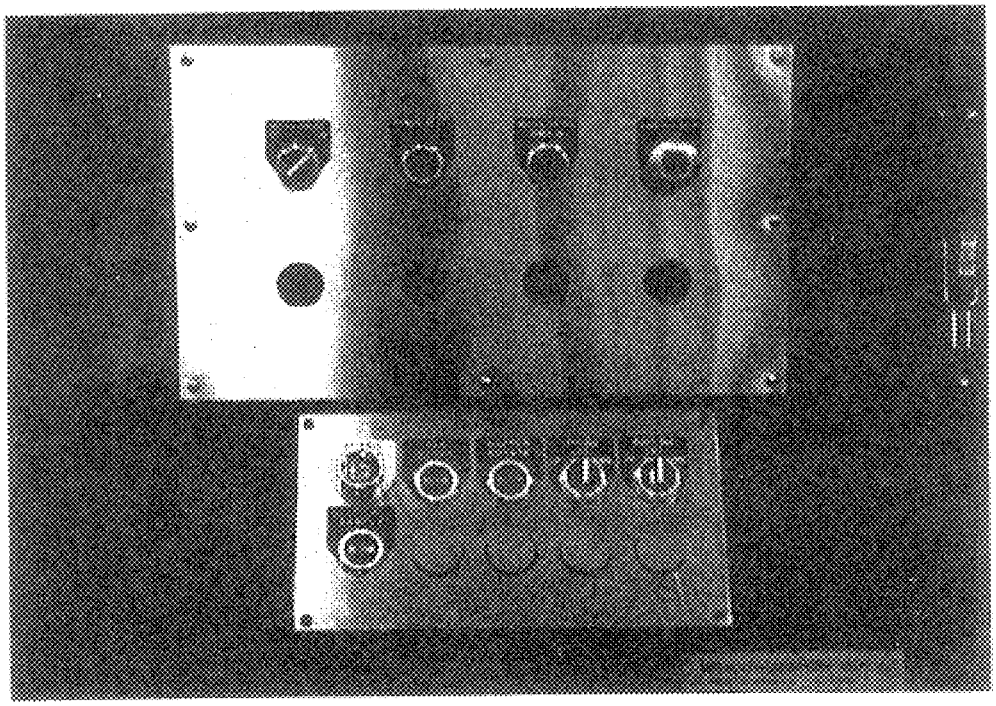

The major components of the bagger apparatus are shown in FIG. 1, which is an over-all plan view of the entire system, comprising the bagger apparatus and palletizer apparatus. For purposes of completeness, the illustrated system can receive three in-feed streams of ends, each on separate rails, which are represented by the blocks at the left of the Single Lane and Dual Lane in-feed mechanisms can be provided separately, or together, or two of the Dual Lane in-feed mechanisms. These mechanisms use the same in-feed, counter/splitter, and lane shifter (in the Dual Lane mechanisms), so the following description apply but are not repeated where there is duplication.

Figures 1, 32A:
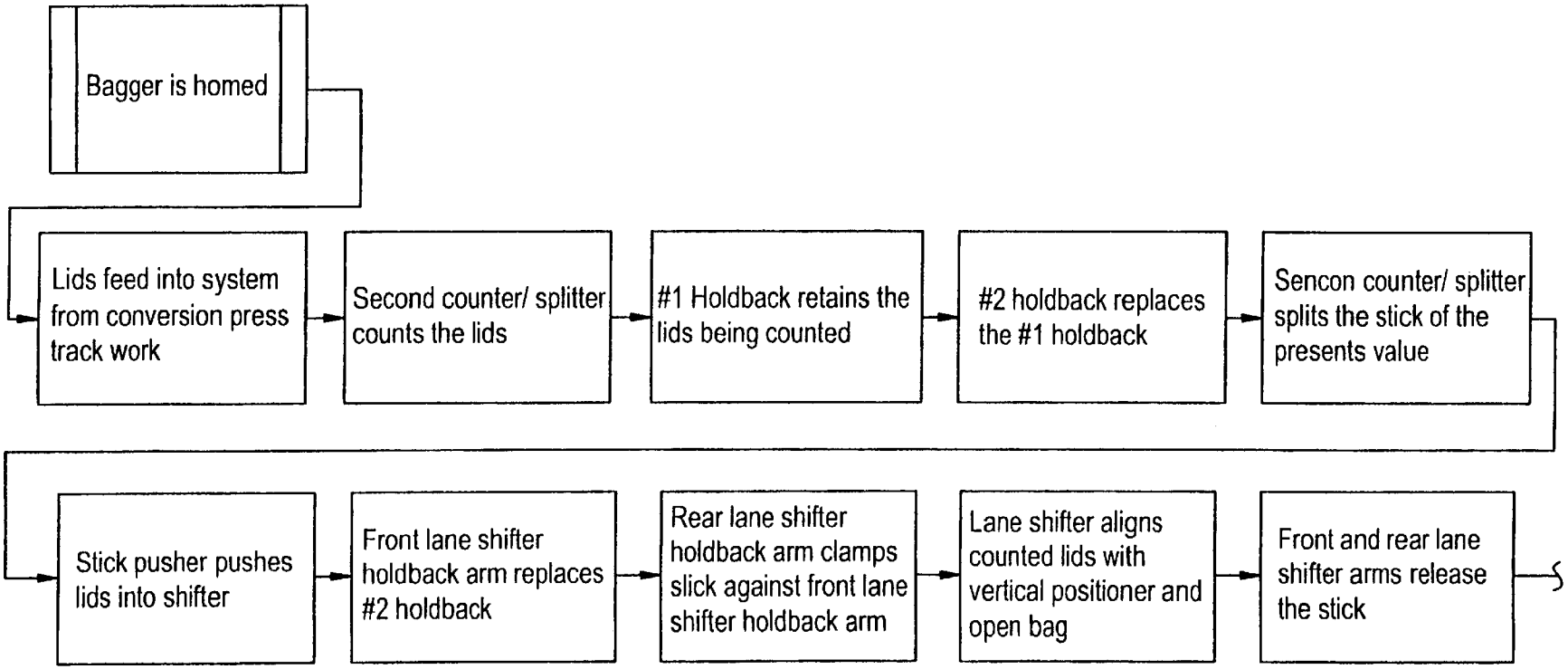
FIGS. 32A and 32B comprise the process flow chart for the bagger apparatus.
Figures 2, 32A:
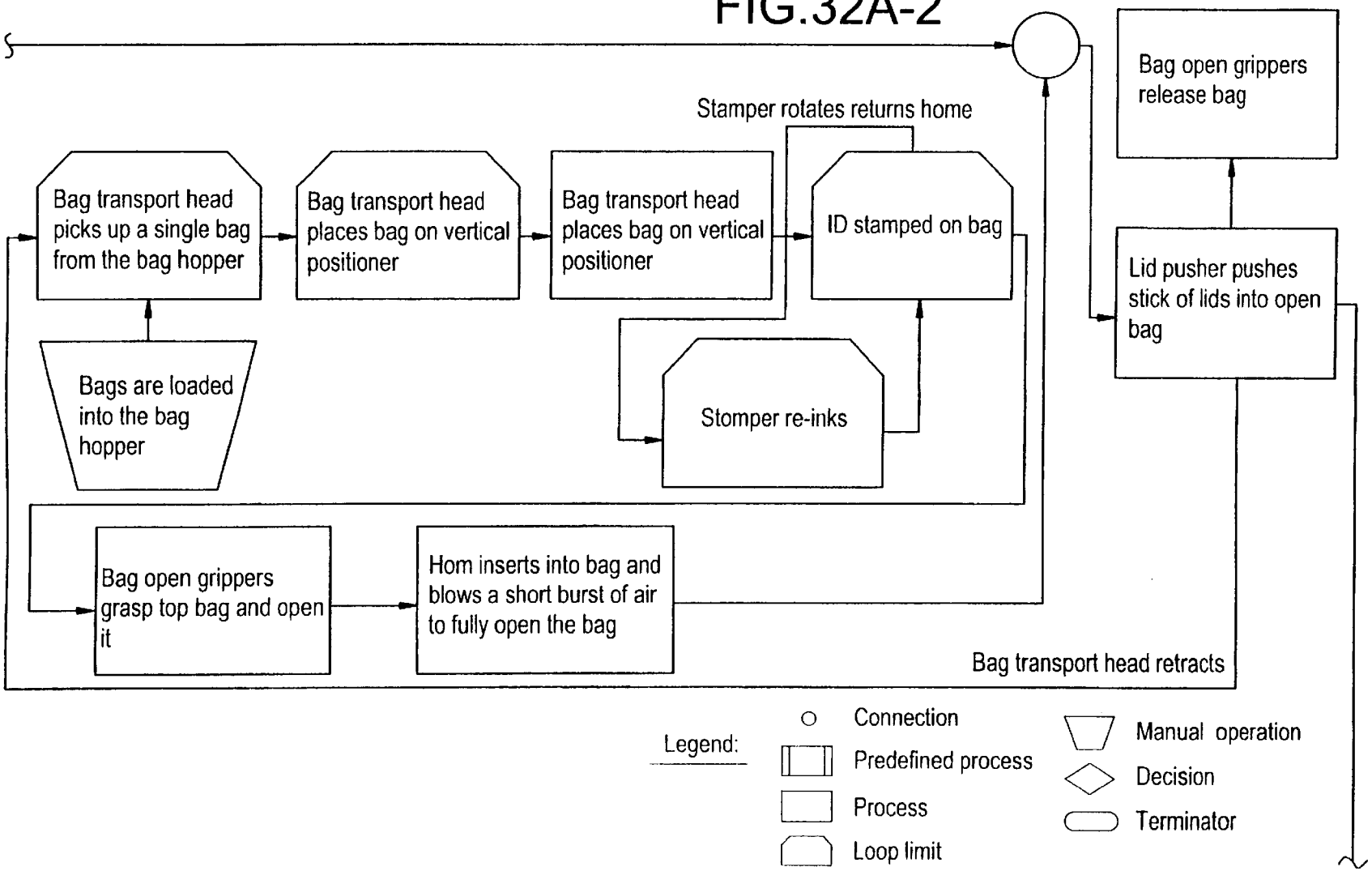
Figures 1, 32B:
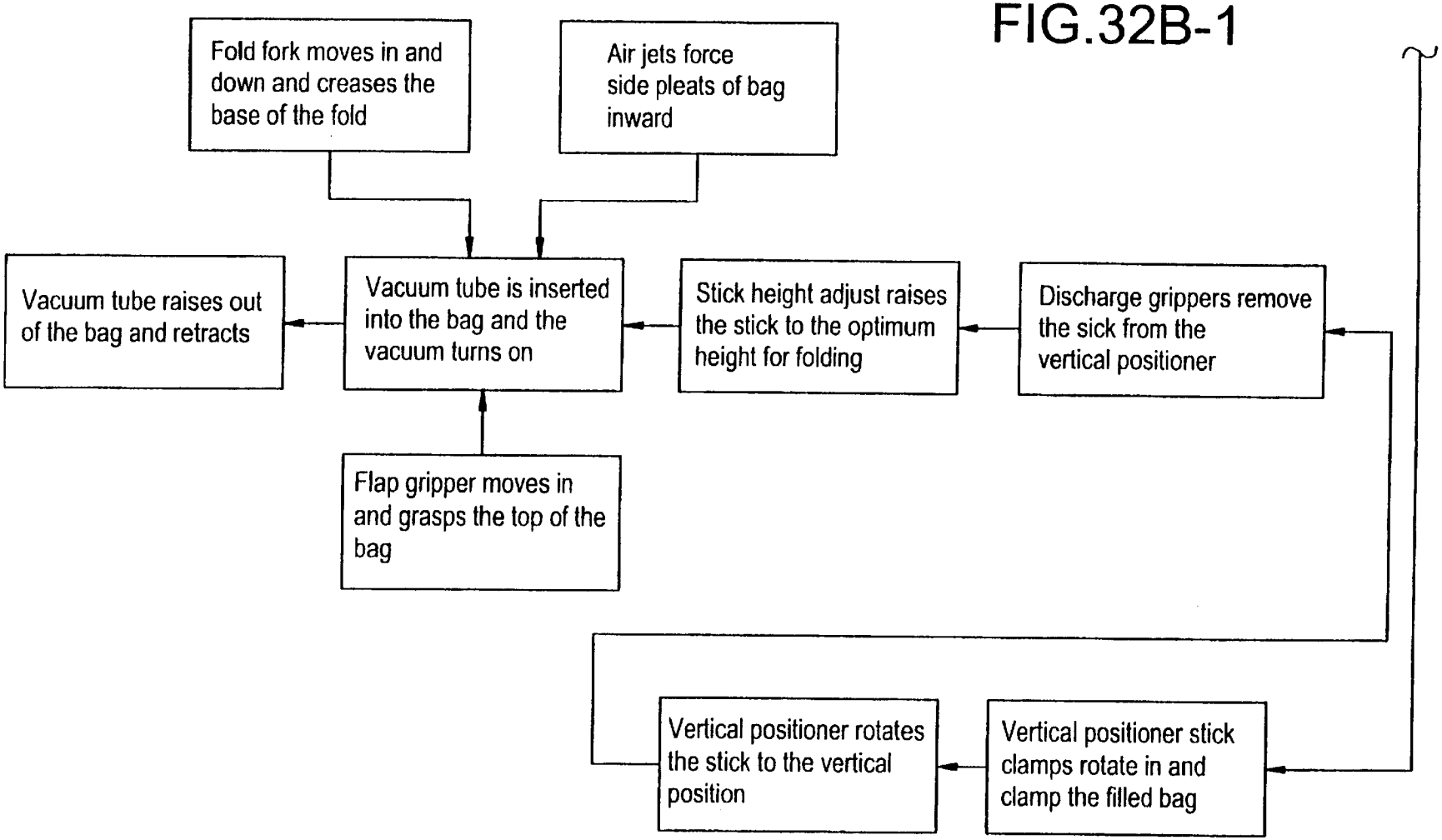
Figures 2, 32B:
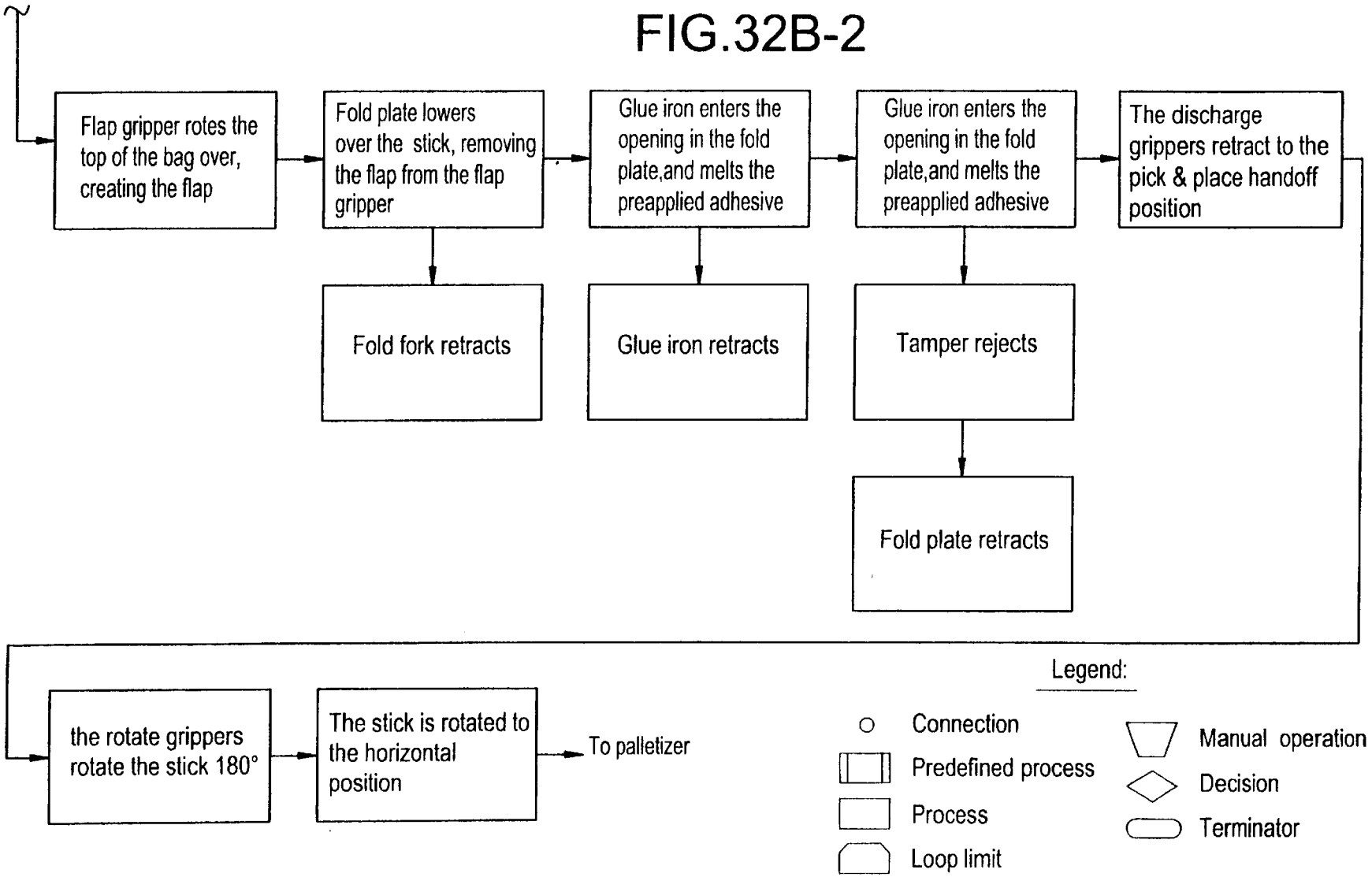

The components of the system are controlled and sequenced by a commercially available programmable controller; an Allen-Bradley Model No. H-4030 is used in an actual embodiment. The Progress Flow Chart of the bagger apparatus is presented in FIGS. 32A and 32B. Persons skilled in the art of programmable controllers will be enabled to reproduce the bagger control system by this information.

Figure 4:
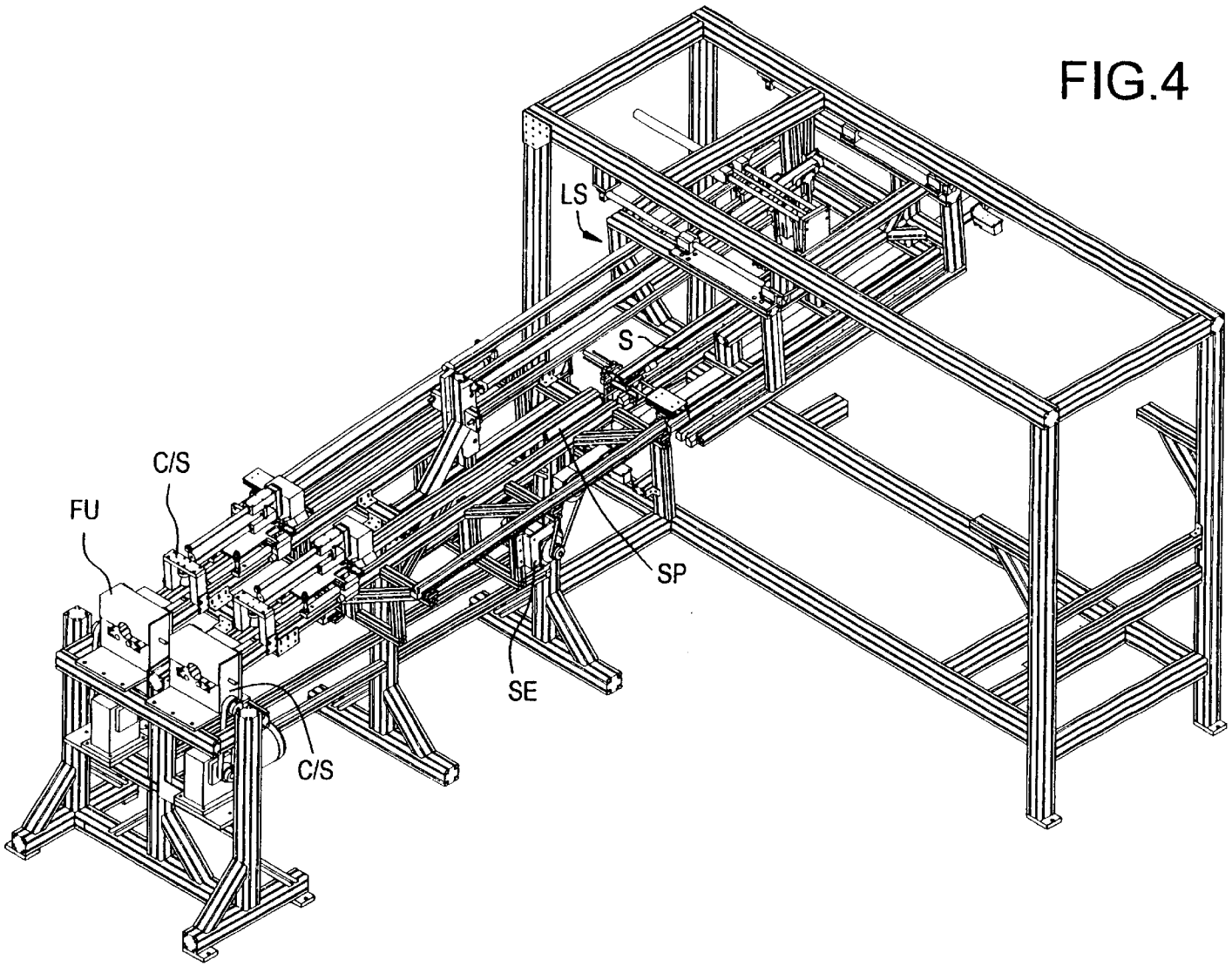
FIG. 4 is a perspective view of a dual end in-feed apparatus for the bagger.
Figure 5:
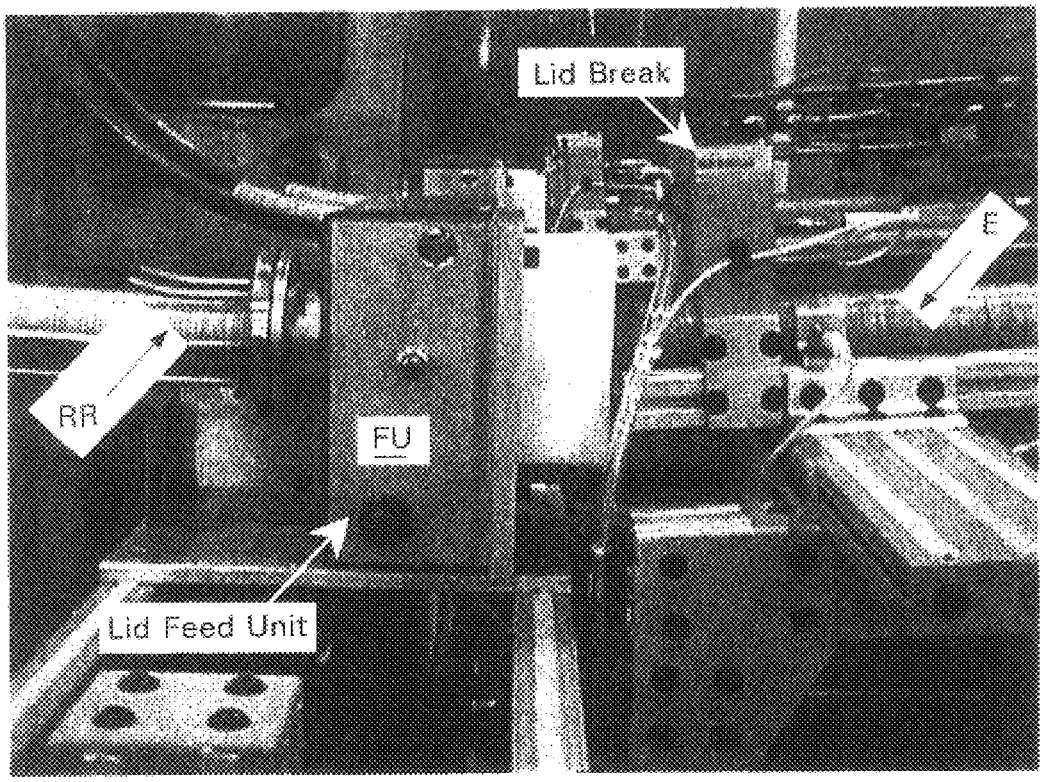
FIG. 5 is a pictorial view of the end feed unit for a single lane bagger.
Figure 6:
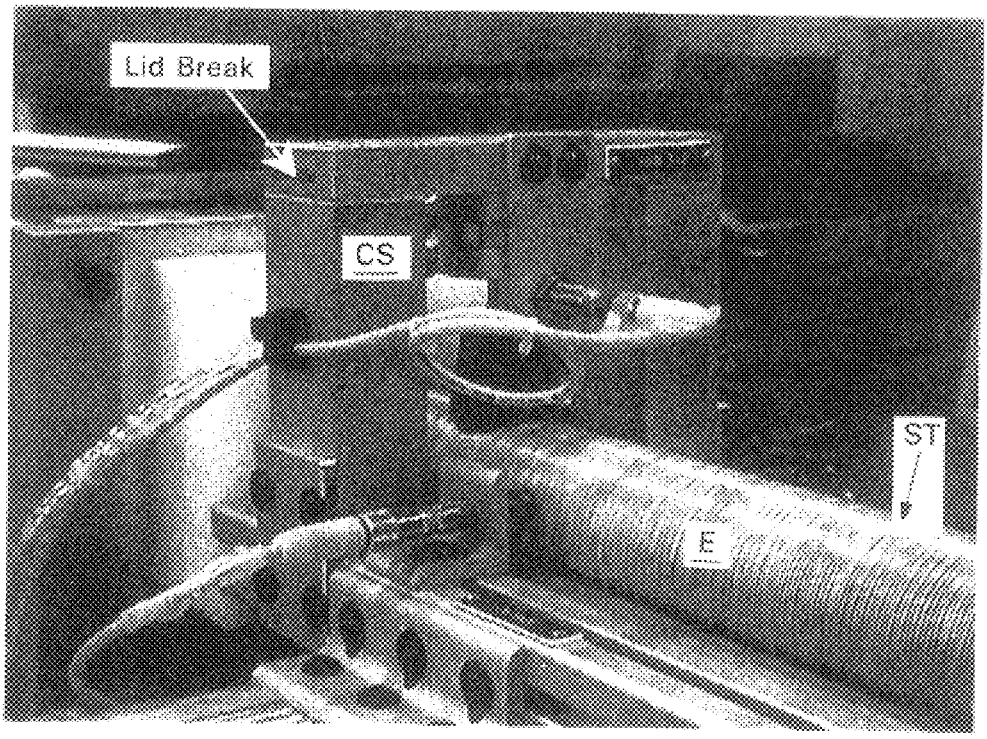
FIG. 6 is a pictorial view of the end stream break device
Figure 7:
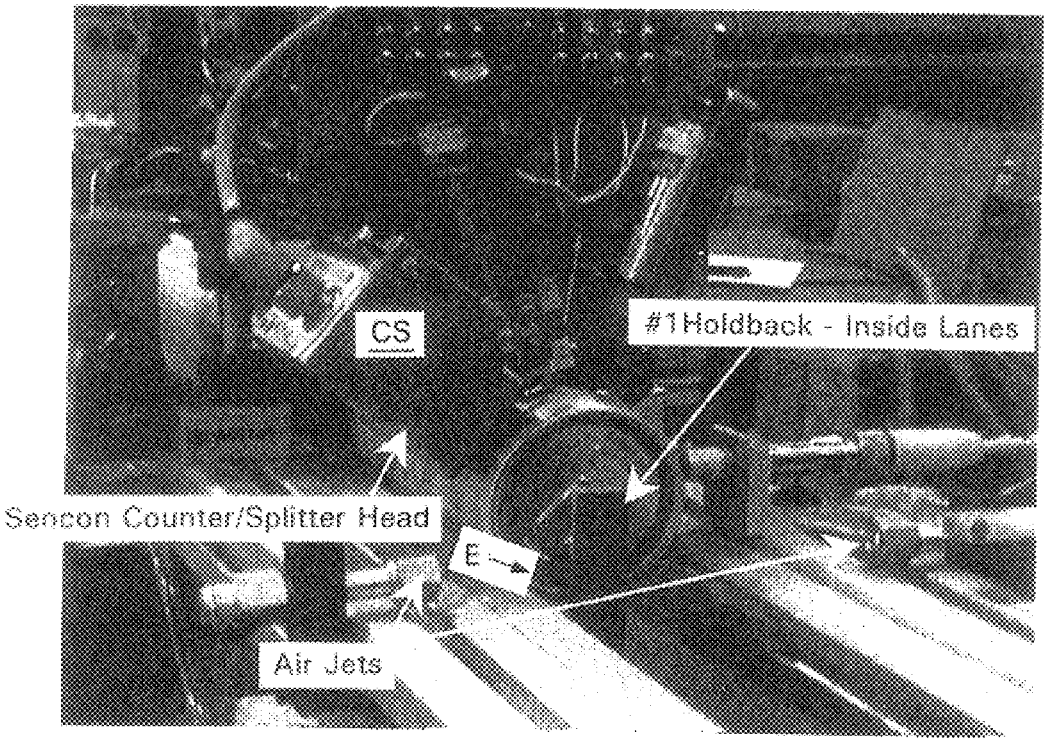
FIG. 7 is a pictorial view of a typical end counter & splitter unit.
Figure 8:
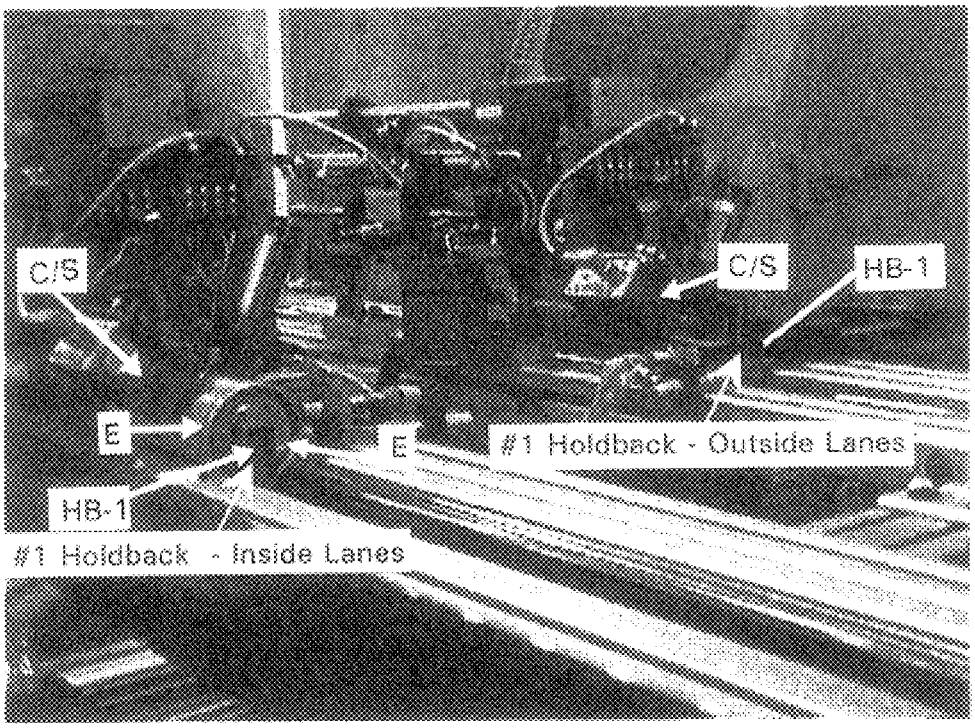
FIG. 8 is a pictorial view of the initial hold back devices on the dual lane bagger.
Figure 9:
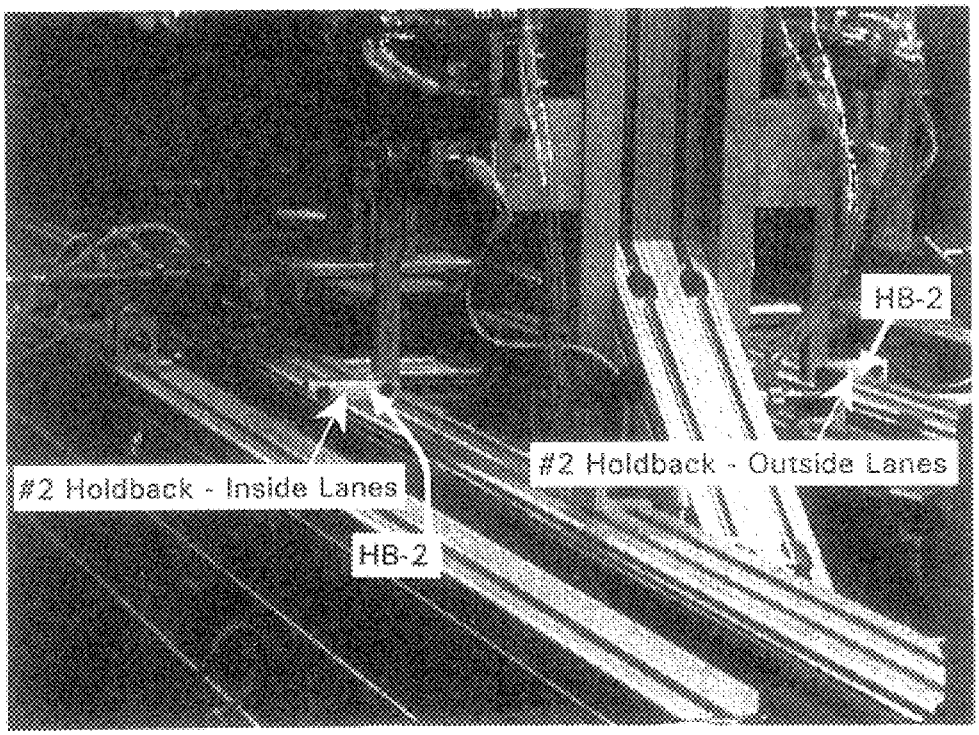
FIG. 9 is a pictorial view of the second hold back devices (inner and outer lanes) in the dual lane bagger.

The bagger apparatus includes:

1) an end feed unit FU which feeds the ends or lids E into the system from the rails RR of the in-feed track work TW; the ends are normally fed product side (the surface which ultimately faces the contents of a can) forward; the public side of the ends E (which may include opening tabs) face backward in the direction of in-feed; as shown in FIG. 1, a complete system may incorporate one or more bagger mechanisms, and those mechanisms can be either single lane or double lane; in dual lane units as seen in FIGS. 1 and 4, there are alternatively operating counter/splitter devices and associated pneumatically driven pusher and hold back mechanisms which form the selected stacks of ends, and the output of one or the other of those is directed to the servo controlled pusher which loads the ends in an opened bag on a vertical positioner apparatus;

2) one or more counter/splitter mechanisms C/S (for example a type such as described in U.S. Pat. No. 5,408,090 of Apr. 18, 1995) which count ends E as they enter the bagger apparatus in a face-to-face stream, and separate them based on a preset value, namely the number of ends to be included in a stick ST;

3) the initial hold back member or arm HB-1 (FIG. 8) which retains those ends E that are currently being counted until they reach the second hold back member or arm HB-2;

4) the second hold back member HB-2 (FIG. 9), which retains the counted group of ends while they are counted, the counted stack split and separated from the incoming stream of ends at the preset value, and while the counted stack is in transit to an open bag B; the second hold back member HB-2 is withdrawn to release the ends just prior to them entering the bag.

Figure 10:
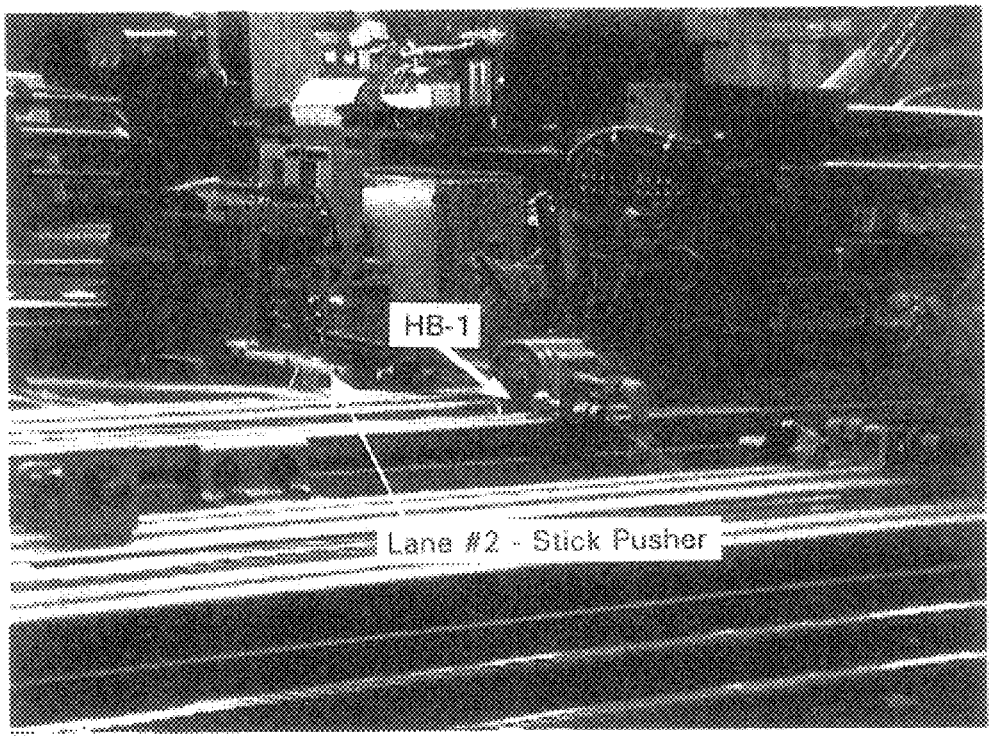
FIGS. 10 and 11 are pictorial views of the stick pusher mechanisms in the dual lane bagger.
Figure 11:
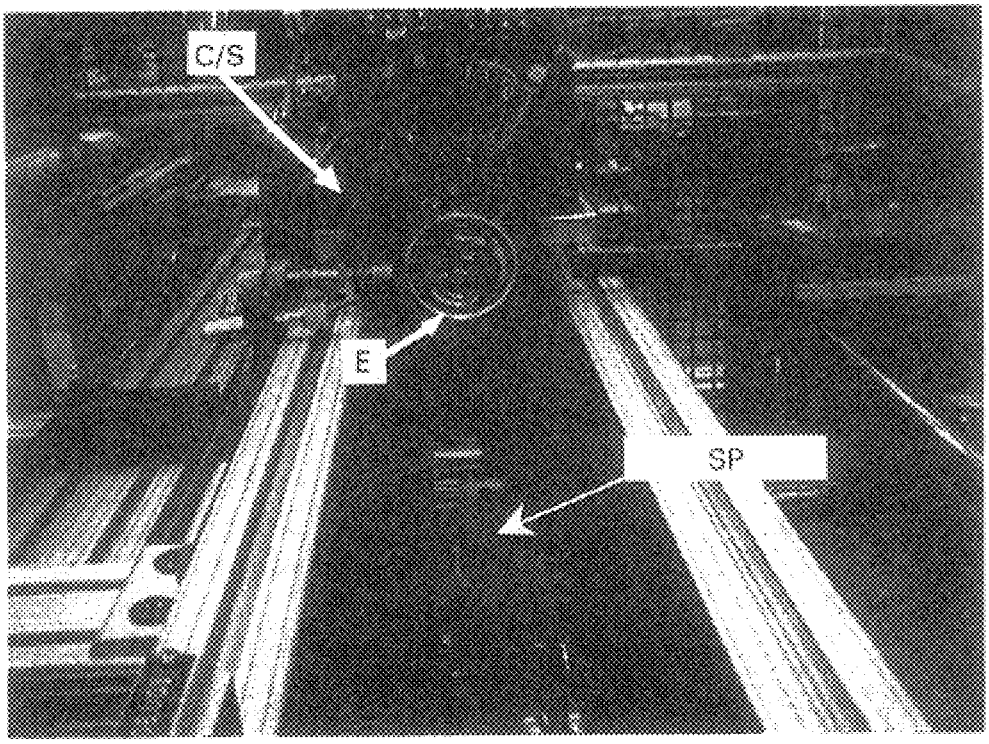
Figure 12:
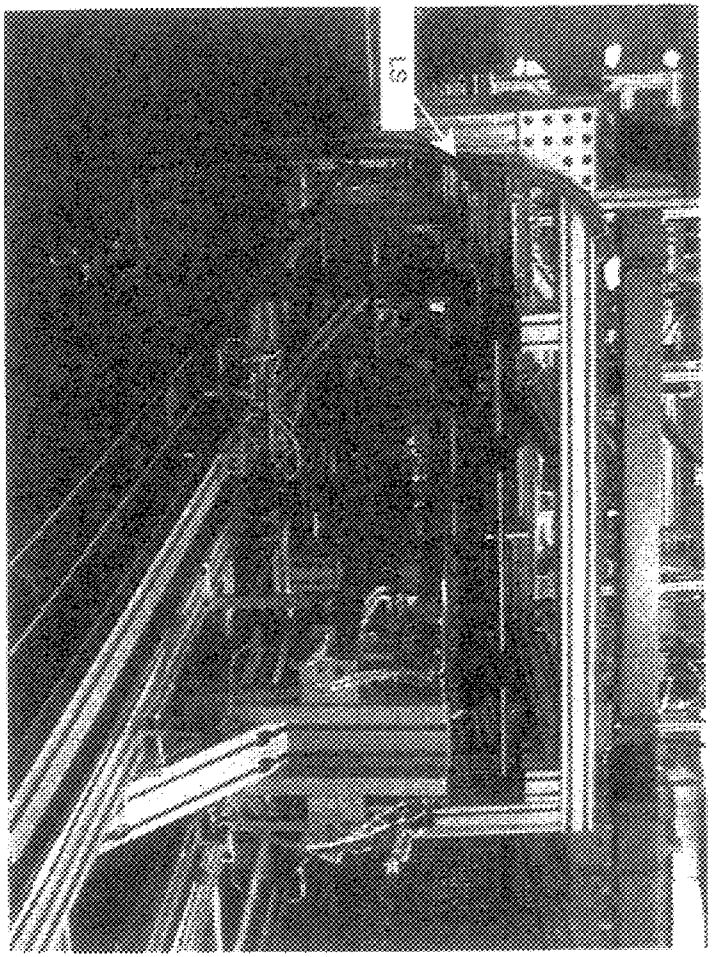
FIG. 12 is a pictorial view of the lane shifter mechanism in the dual lane bagger.
Figure 13:
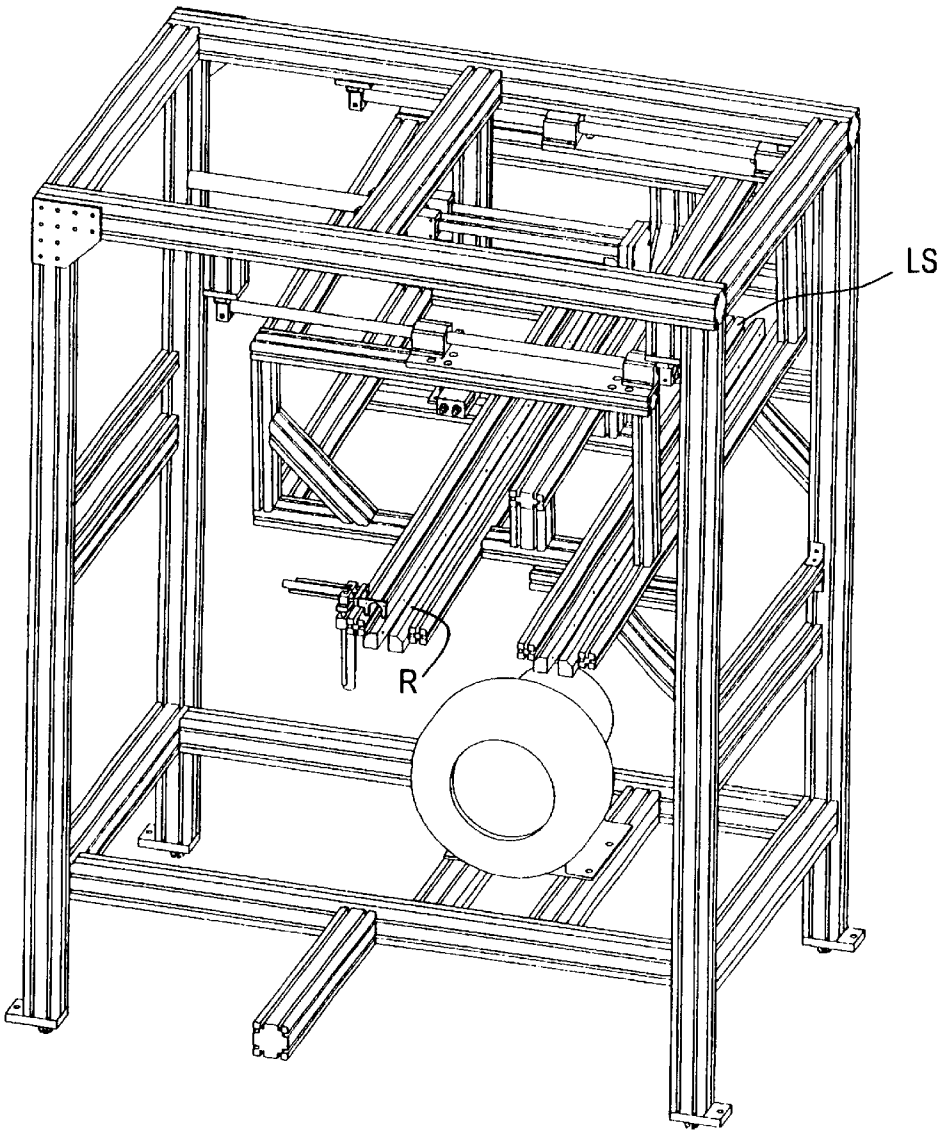
FIG. 13 is a pictorial view of the lane shifter for the dual lane bagger.
Figure 14:
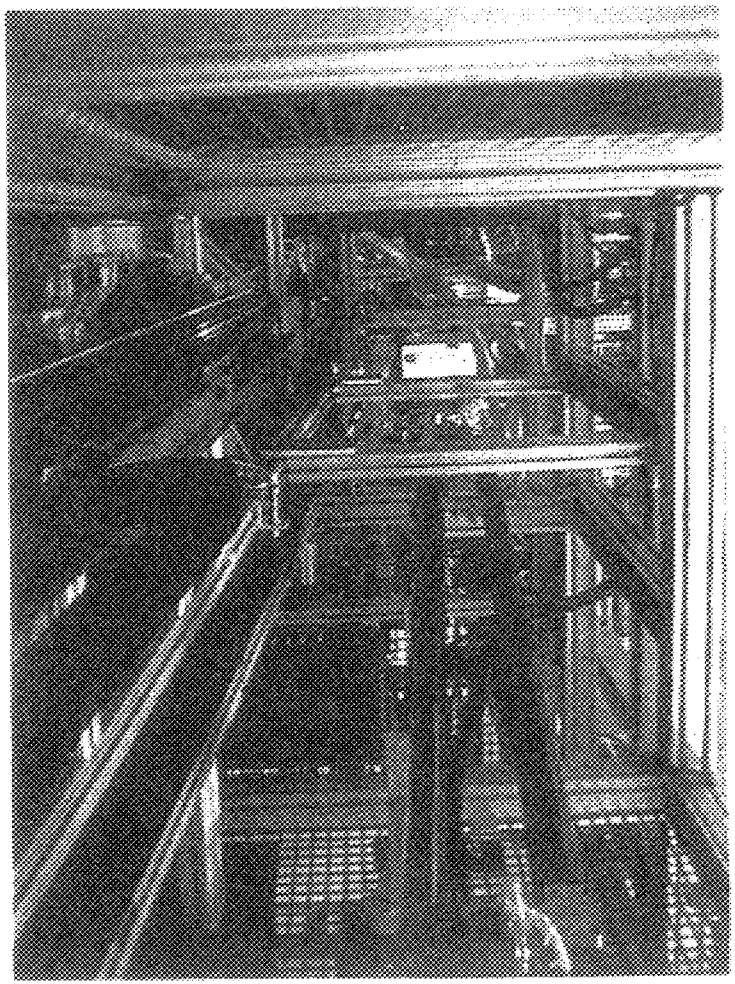
FIG. 14 is a pictorial view of the lane shifter for the single lane bagger.
Figure 21:
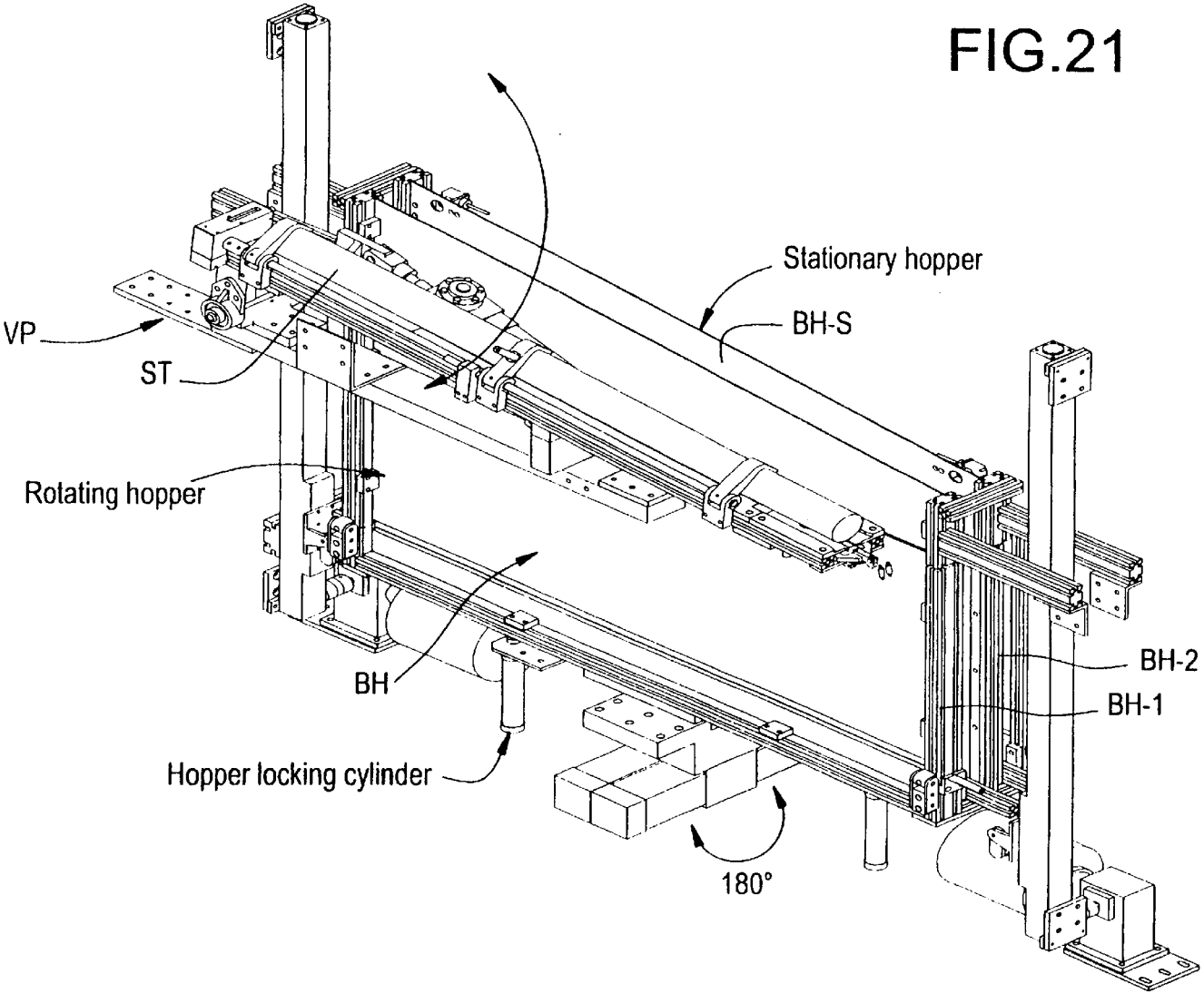
FIG. 21 is a pictorial view showing the relationship of the bag feed hopper and the vertical positioner.
Figure 22:
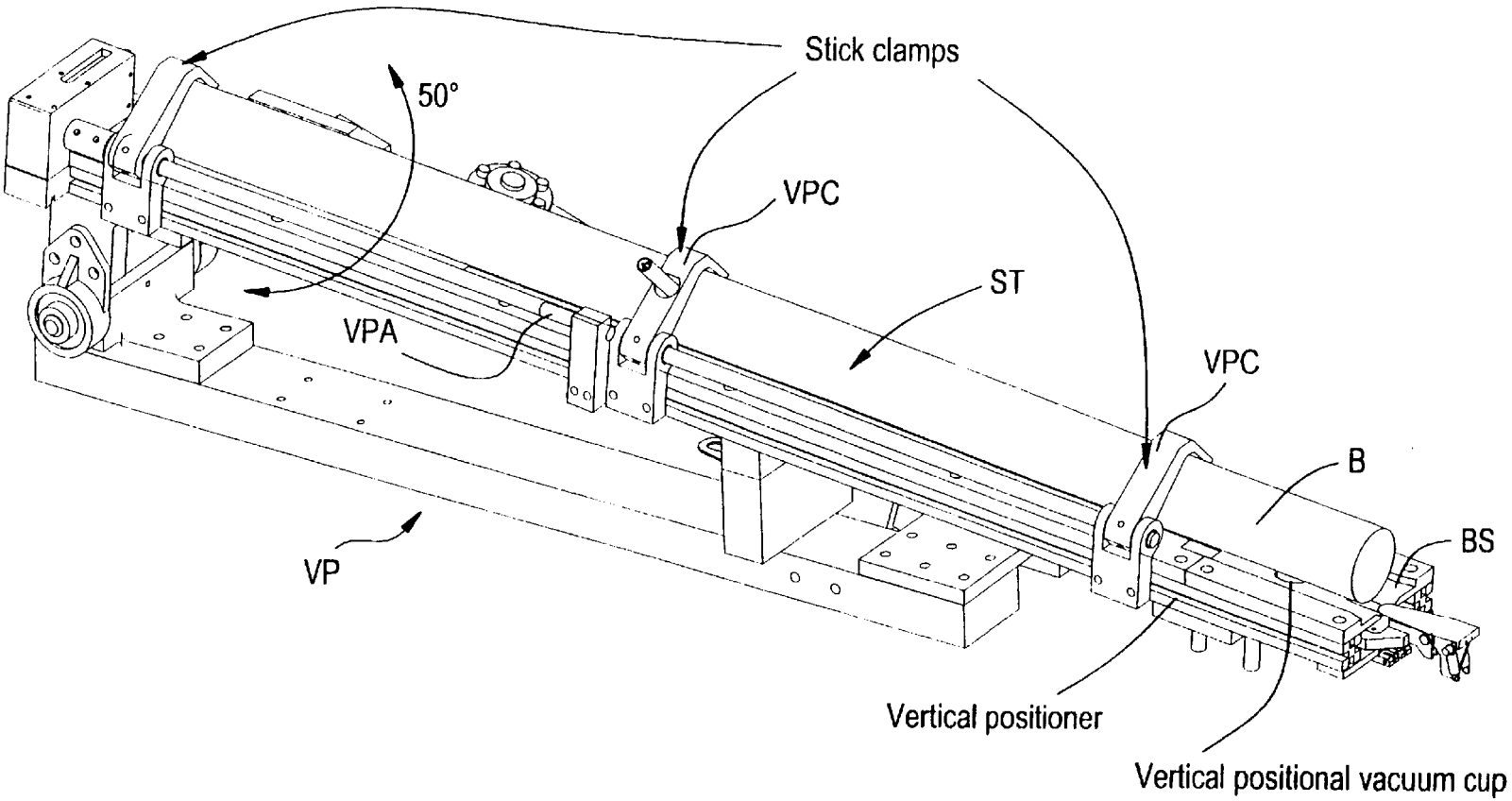
FIG. 22 is a perspective view of the vertical positioner, including its stick clamps and vacuum cup.

FIGS. 10 and 11 show the servo controlled end pusher SEP, which is at the end of the servo driven rod SPR which transports the ends from the counter/splitter C/S into a bag B which is held, with its mouth or entry end open on the Vertical Positioner mechanism VP (FIGS. 1 and 22). This mechanism includes a bottom bag support BS on which an empty bag B is placed and held. The positioner VP, in its lower or receiving position, extends as a continuation of the support rails R, and all are slanted upward at a slight angle (e.g. five degrees), as seen in FIGS. 13, 16, 21 and 22.

Figure 24:
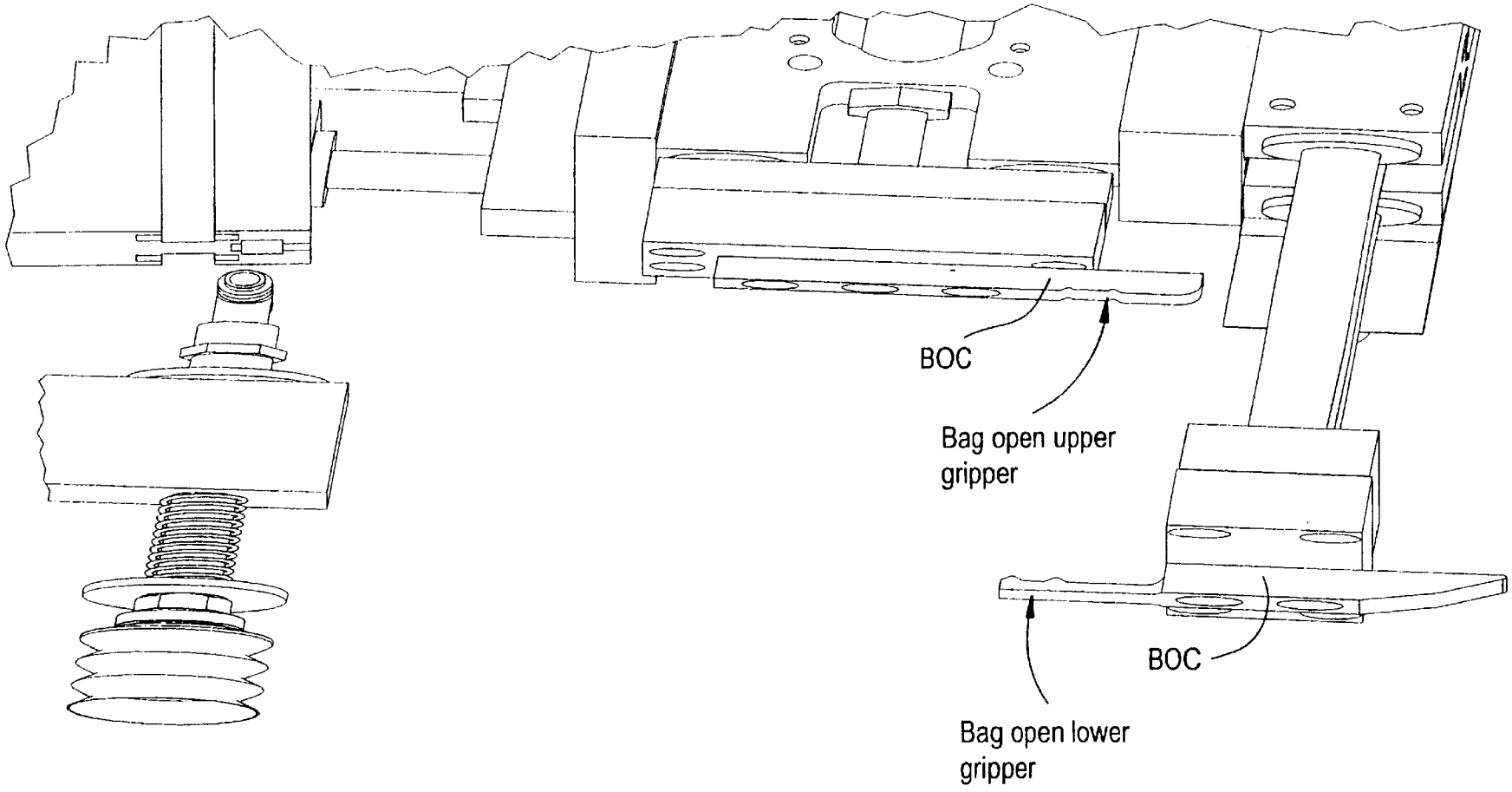
FIG. 24 is an enlarged perspective view of the bag opening grippers associated with the vertical positioner.

A bag B is placed in the positioner VP, then bag opening clamps BOC (FIG. 24) grasp and pull open the mouth of the bag. A horn guide HG is extending into the open bag mouth, and i; is through this guide HG that the selected stack of ends is pushed into the open bag. The vertical positioner clamps VPC then close on the filled bag, and the entire vertical positioner swings upward, with the open end of the bag at the top, into its second or vertical delivery position where folding of the bag ends flaps occurs. Thus, the vertical positioner VP traverses a swing motion of about fifty degrees between its two positions. This unique action in the present invention eliminates the turned ends found in manual bagging, semi-automatic bagging, and other automatic bagging systems.

The counted and selected ends in the separated stack, being transported to the bag to form a stick, have a certain amount of sponginess or spring action in their face-to-face relationship. Upon initial acceleration, the selected ends E are compressed because the ends close to pusher SEP (at the rear of the stack) move more rapidly than those ends farthest away from the pusher. After a short period of time, the selected stack of ends E reach a maximum compression (i.e., they act as a solid body) and therefore have a constant velocity in relationship to each other. If allowed to precede at the then existing acceleration, the moving stack of ends will try to obtain the lowest energy state by decompressing.

Since the ends at the pusher are restrained by the second hold back member HB-2, the ends farthest away from the pusher tend to spring away from the ones behind. This creates the potential for the ends on the forward end of the moving stack away from the Pusher to fall over.

To rectify this situation, the servomotor SE controlling the rod SPR is programmed with a special algorithm (per se known) which accelerates the stack of moving ends to the point of maximum compression, then decelerates those ends at a rate proportioned to the rate at which they have a natural tendency to decompress (i.e. the spring rate). This allows the stack to release its stored energy without causing the ends to fall over. The ends are then re-accelerated to some minimum required velocity to complete their movement into the bag and are brought to a halt without an abrupt physical stop within a calculated adequate stopping distance.

The algorithm to produce this type of movement has been, termed the "S" curve because of the S-shaped pattern that the movement produces when viewed on an oscilloscope. The accelerations and decelerations are adjusted based on the amount of counted ends per stick and the required amount of travel.

In one commercially available servomotor (supplied by Allen-Bradley Model No. H-4030), the Average Acceleration command allows the user to specify the Average Acceleration for an S-curve motion profile. S-curve profiling provides smoother motion control by reducing the rate of change in acceleration and deceleration; this rate of change is commonly known as jerk. The values for "Maximum Acceleration" and "Average Acceleration" commands determine the characteristics of the S-curve. To smooth the acceleration ramp, one can enter an Average Acceleration command value that satisfies the equation:

$$\frac{1}{2}\text{ Max. Acceleration} \leqq \text{Average Acceleration} < \text{Max. Acceleration}$$

BAG SUPPLY

Figure 19:
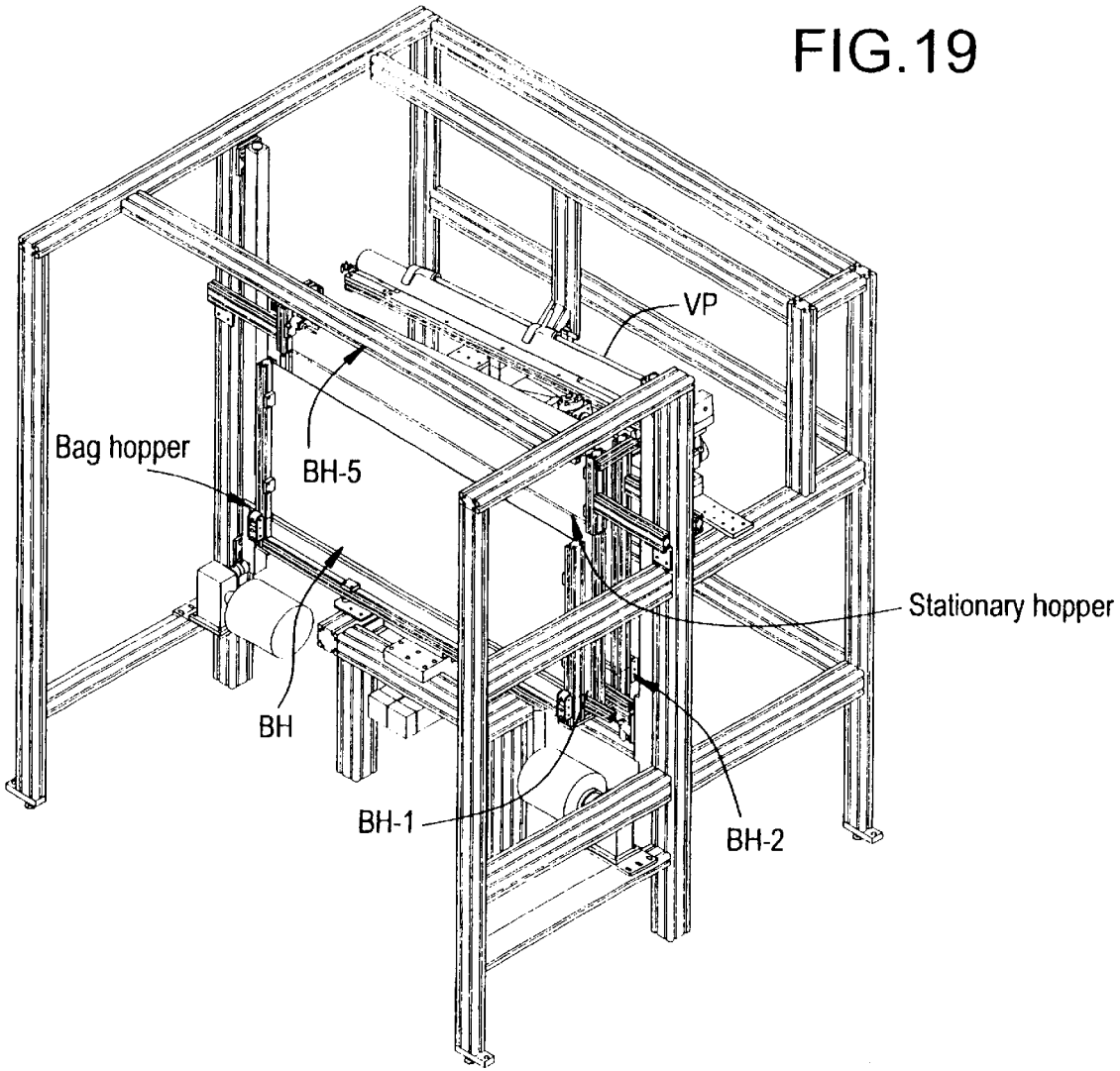
FIG. 19 is a pictorial view of the bag supply hopper mechanism.

The bag hopper section, seen in FIGS. 19 and 21, contains a movable hopper BH with two side-by-side interchangeable open top trays BH-1 and BH-2, with generally rectangular sides and narrower rectangular ends, defining a cavity which corresponds to and receives the stacks of folded bags. Thus each tray can hold a supply of empty flat folded bags B, and a stationary hopper BH-S, which functions as a guide and provides a fixed bag delivery location, is located to one side of the vertical positioner VP and above the bag payoff location.

The stationary hopper functions as a guide to establish a constant location from which a bag can be picked up. This hopper has a lower or inlet bottom corresponding in size and shade to the top of the trays. Each of the trays BH-1 and BH-2 can be moved, alternatively, into position closely spaced beneath the stationary hopper BH-S, so a bag supply can be moved upward through the trays and through hopper BH-S. The top opening of stationary hopper BH-S extends at an angle corresponding to the slope of the vertical positioner VP. Within each tray there is a feed mechanism which comprises a moving bottom plate fixed at its opposite ends to motor driven belts which can step the bottom plate upward as the bag supply therein is depleted. When a tray is filled with a fresh supply of bags and moved under stationary hopper BH-S, these belts tilt the bottom plate at an angle corresponding to the upper edge of the stationary hopper. Thus, as the bags are fed upward in operation of the bagger mechanism, the stack of bags in the active tray is staggered or sloped to place each succeeding bag at essentially the same angle as to top opening of the stationary hopper BH-S.

Thus the active tray is located in the payoff position, at which the bags are successively removed from the hopper BH-S by the bag transport head BTH and placed on the vertical positioner VP. The other tray is at that time in the fill position. If empty, the other tray is accessible through door guards for re-filling, and awaits transfer to the payoff position after filling is complete and the supply of bags in the active tray is depleted, by swinging the trays through 180°.

It is desirable to "fan" the bags to ensure that all bags are separated from each other, because the pre-applied adhesive for the fold and the adhesive at the bag seam can cause the bags to adhere to each other. If the bags are not separated, the bag transport head BTH may not be able to lift a single bag, and a system fault will occur. The stack of bags can then be placed "glue side up" into the hopper tray. These steps may have to be repeated to fill the tray with up to 350–400 bags (7–8 packages of 50).

Figure 20:
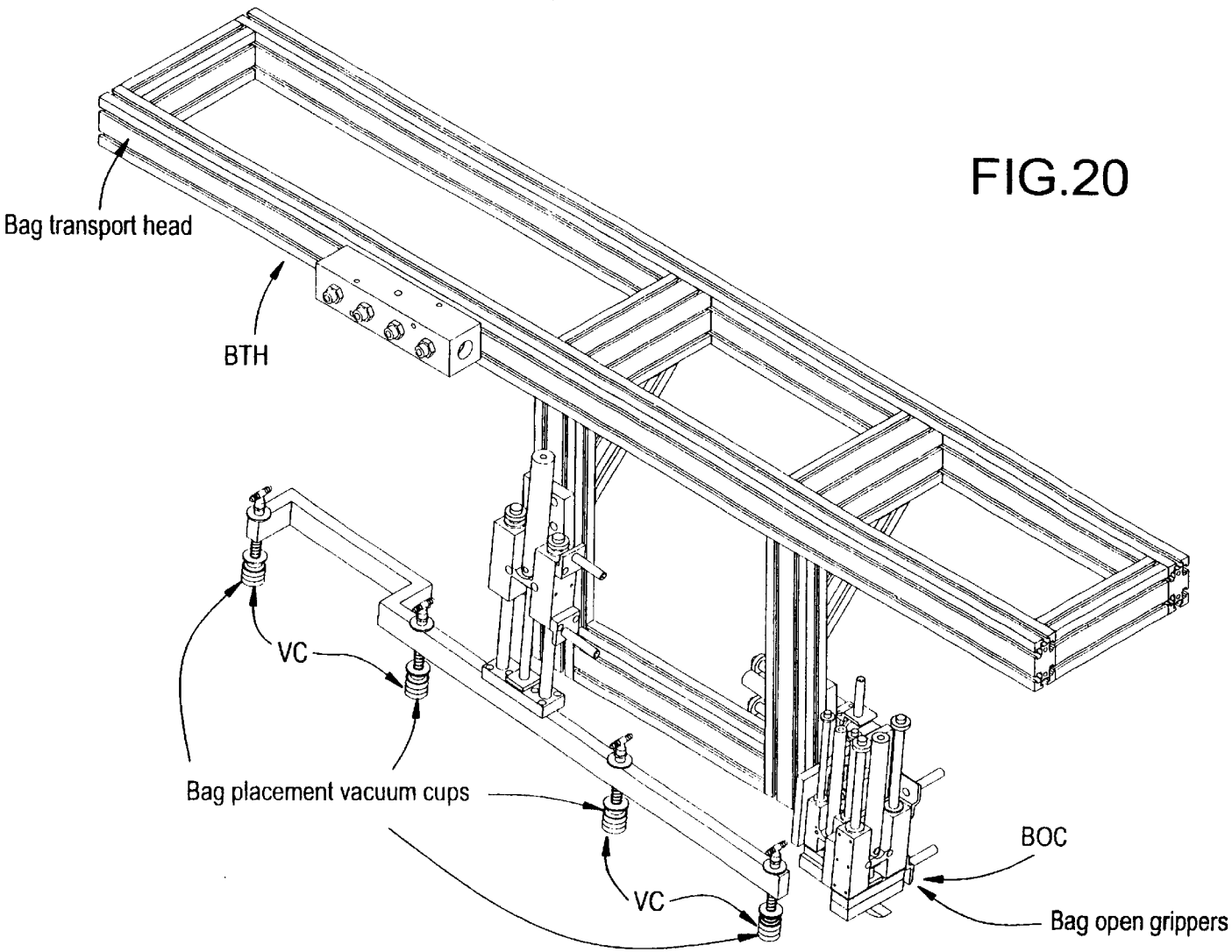
FIG. 20 is a pictorial view of the bag transport head and grippers.
Figure 25:
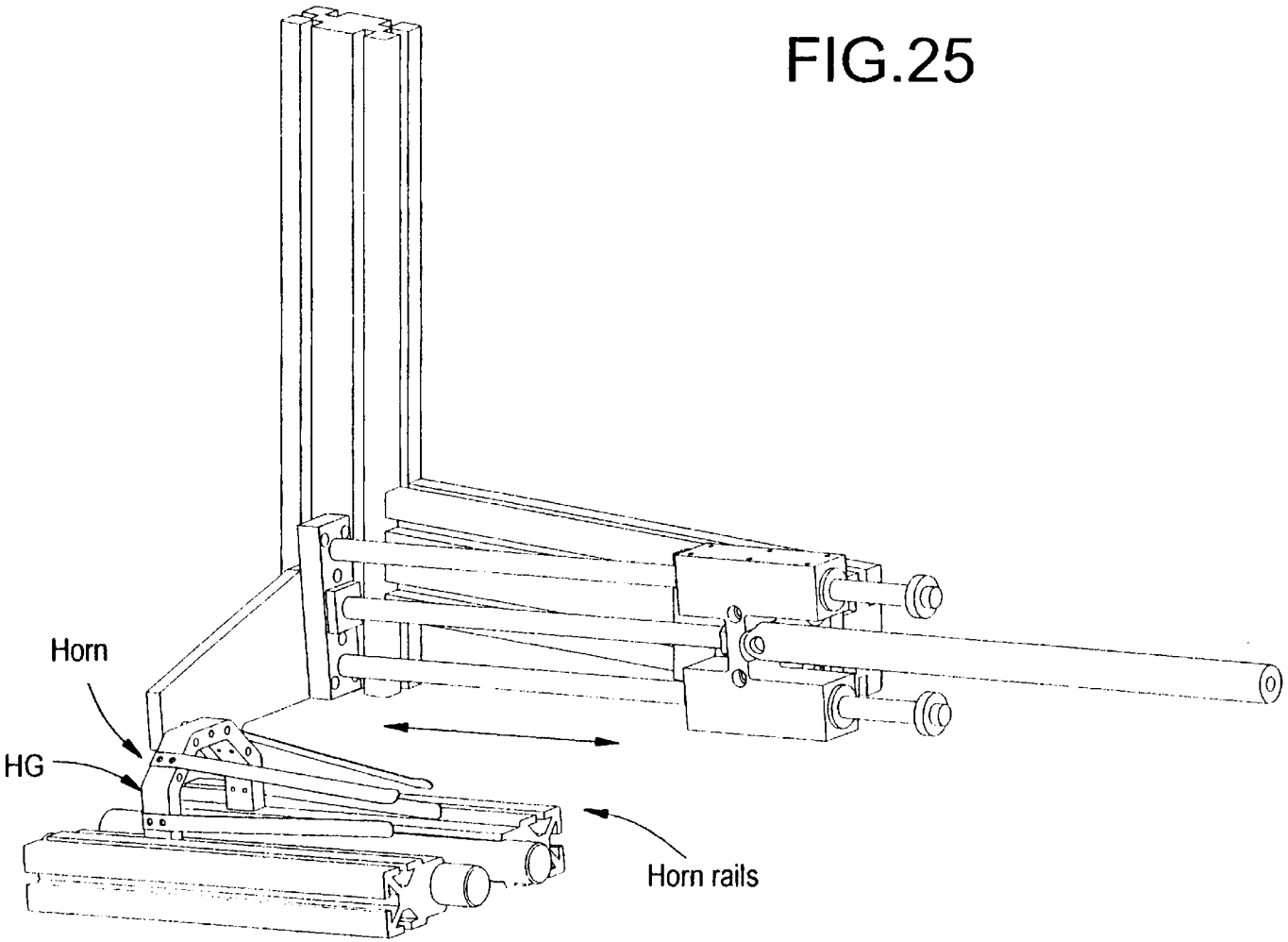
FIG. 25 is an enlarged perspective view of the horn and it control mechanism associated with the bag opener.
Figure 26:
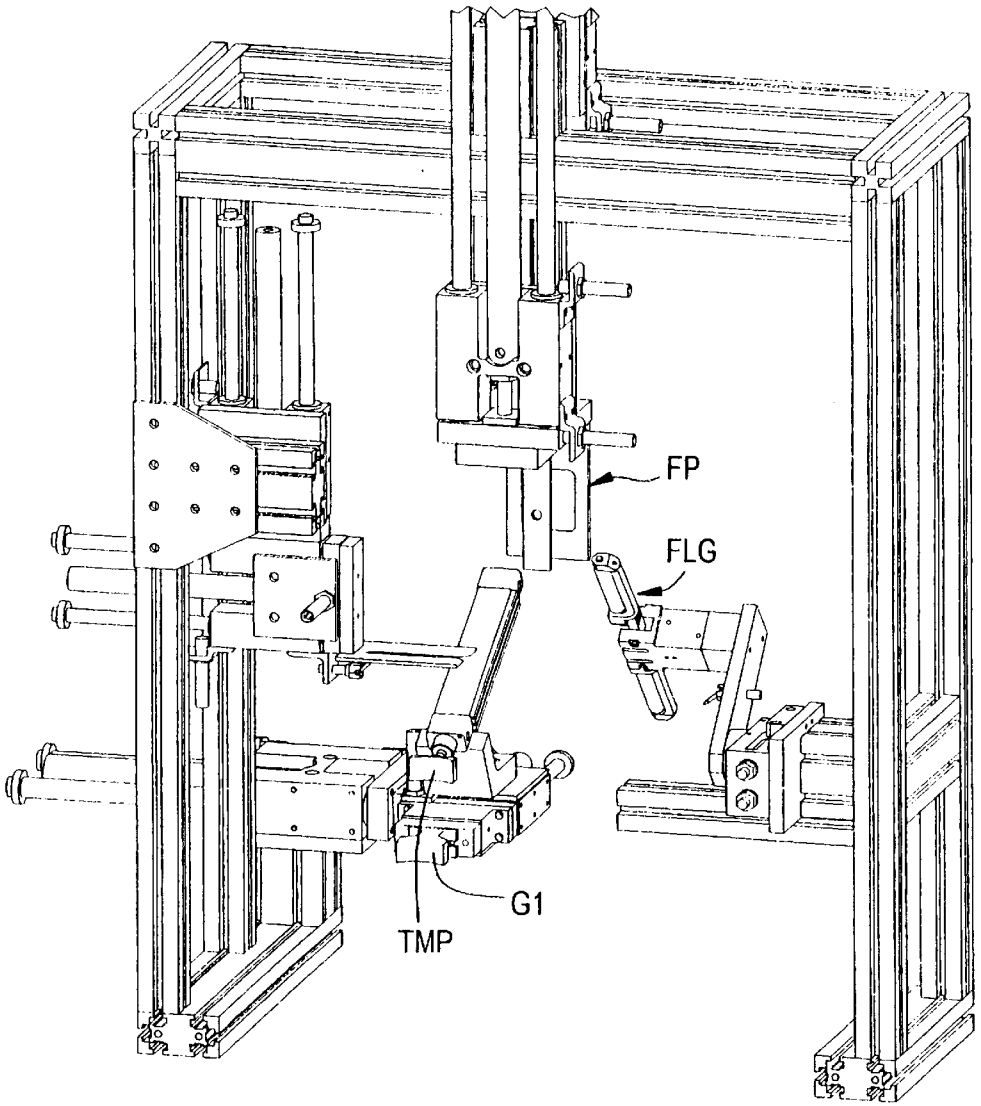
FIG. 26 is a perspective view of the fold section which receives a stick from the vertical positioner.
Figure 27:
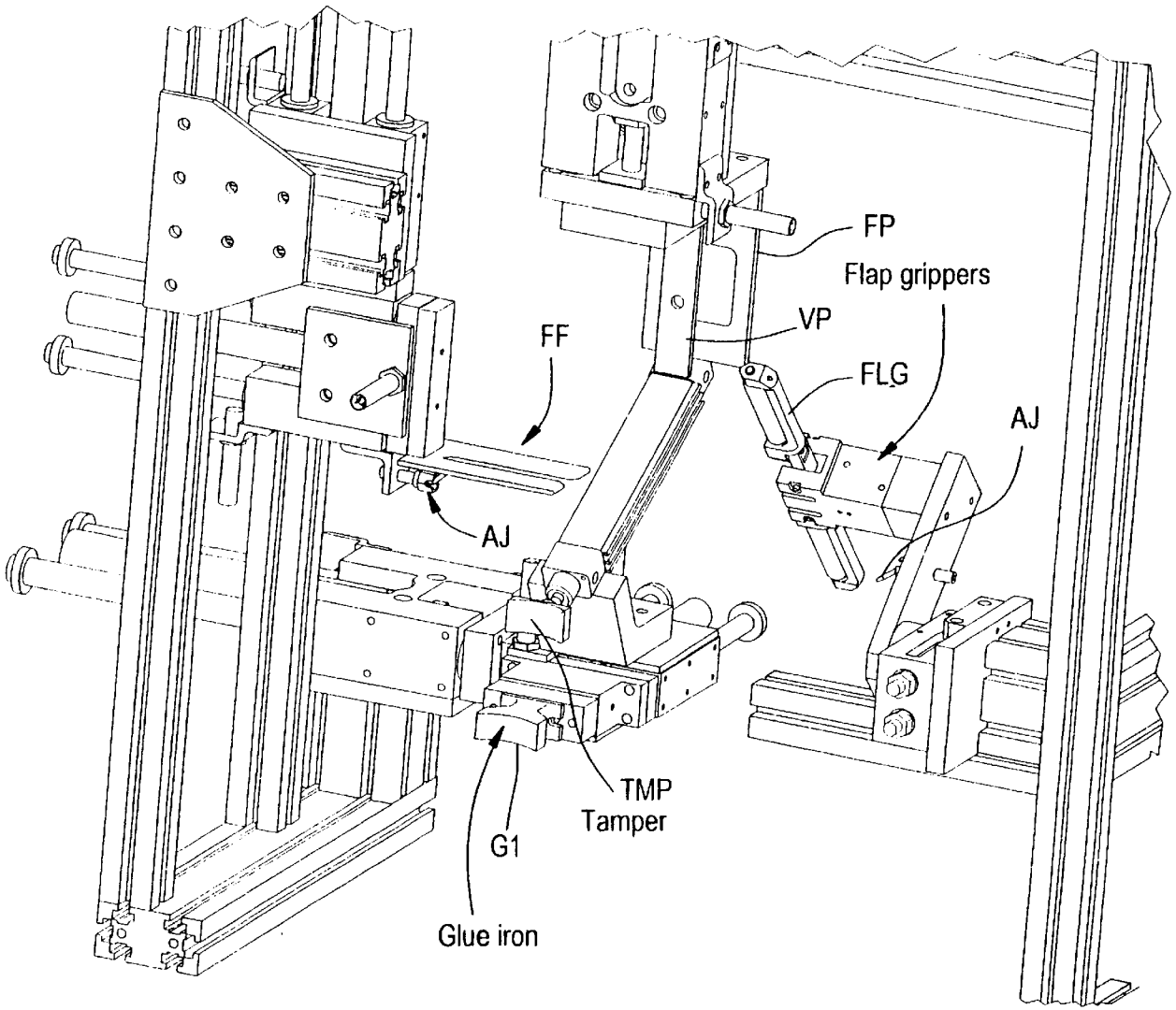
FIGS. 27, 28 and 29 are enlarged perspective views of the fold section taken from the back and sides thereof.
Figure 28:
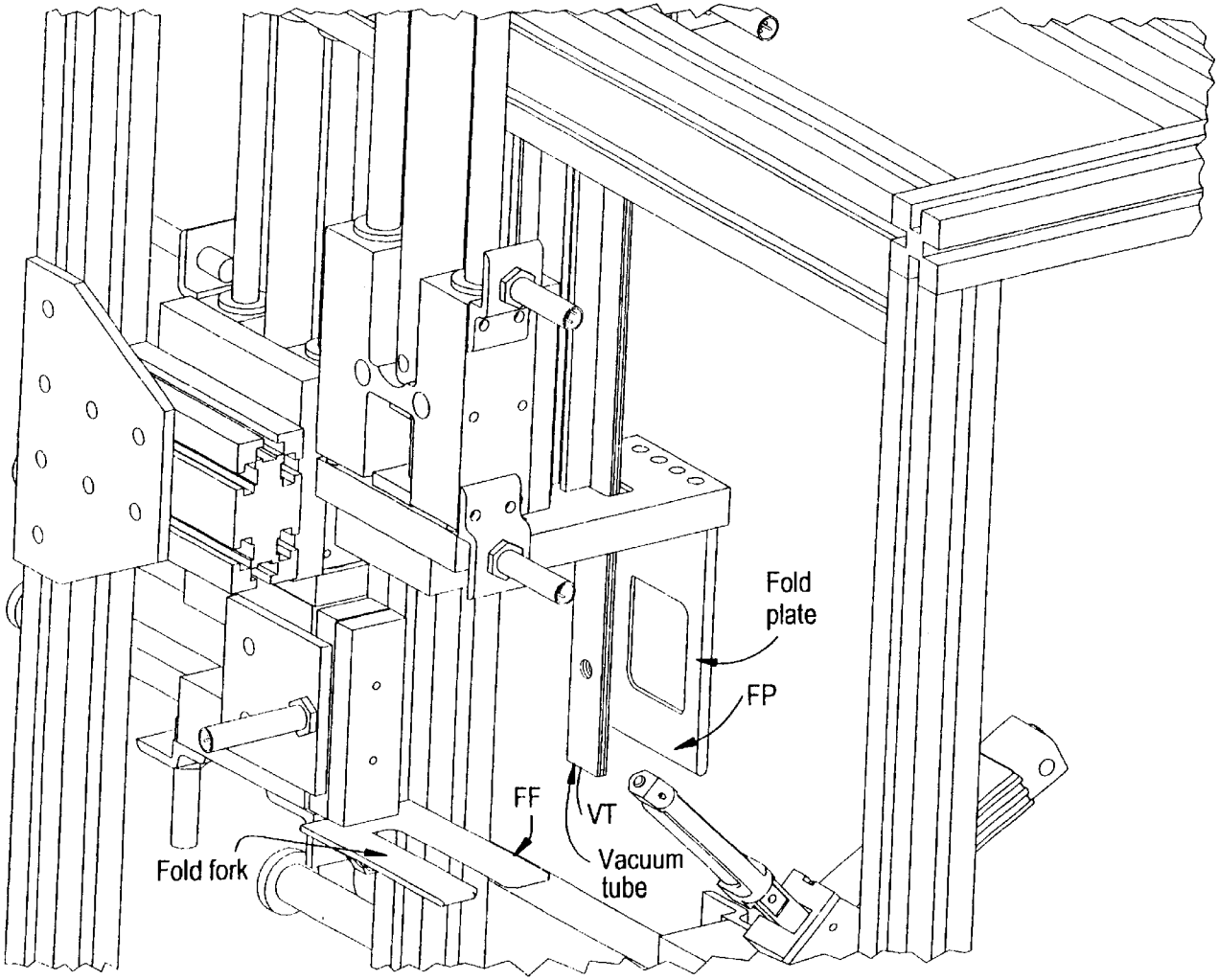
Figure 29:
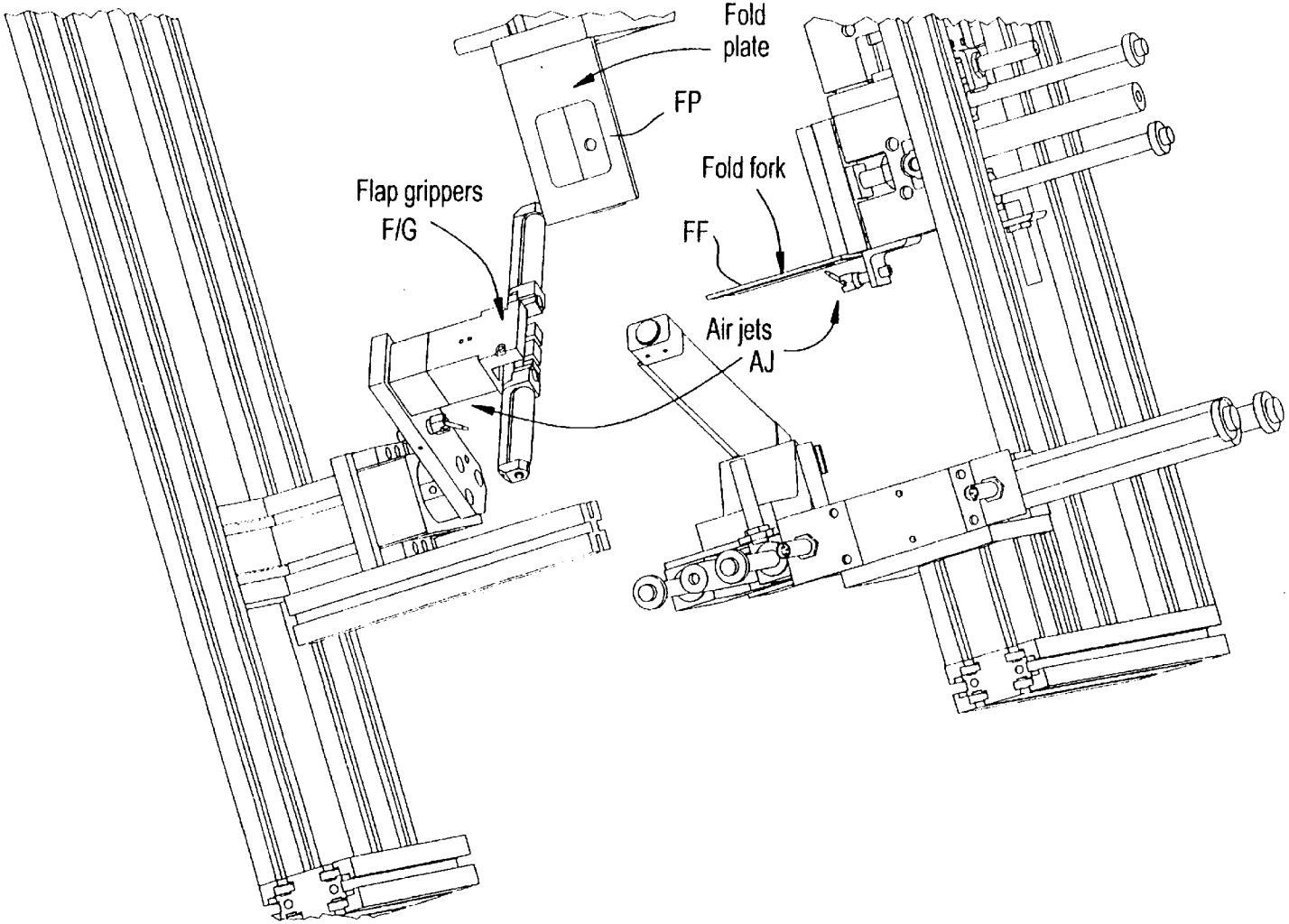

The bag transport head BTH, shown in FIG. 20, lifts a single, empty bag and places it on the vertical positioner VP. Vacuum cups VC grasp the bottom side of a bag B while the bag is being blown open. The tip of the Horn H, shown in FIG. 25, inserts into the open end of the bag and blows a short burst of air into the bag to open it fully. The servo controlled pusher SEP then actuates, in the manner previously described, to insert the stick of counted and separated ends E into the bag.

A set of stick clamps VPL, supported on an operating arm VPA, and associated with the vertical positioner VP (see FIG. 22, close around and hold the bag when it is filled, after which the vertical positioner VP swings and raises, carrying the filled bag (i.e., stick) from the sloped (slightly below horizontal) filling location (FIG. 22) to the vertical folding and closing position.

Figure 23:
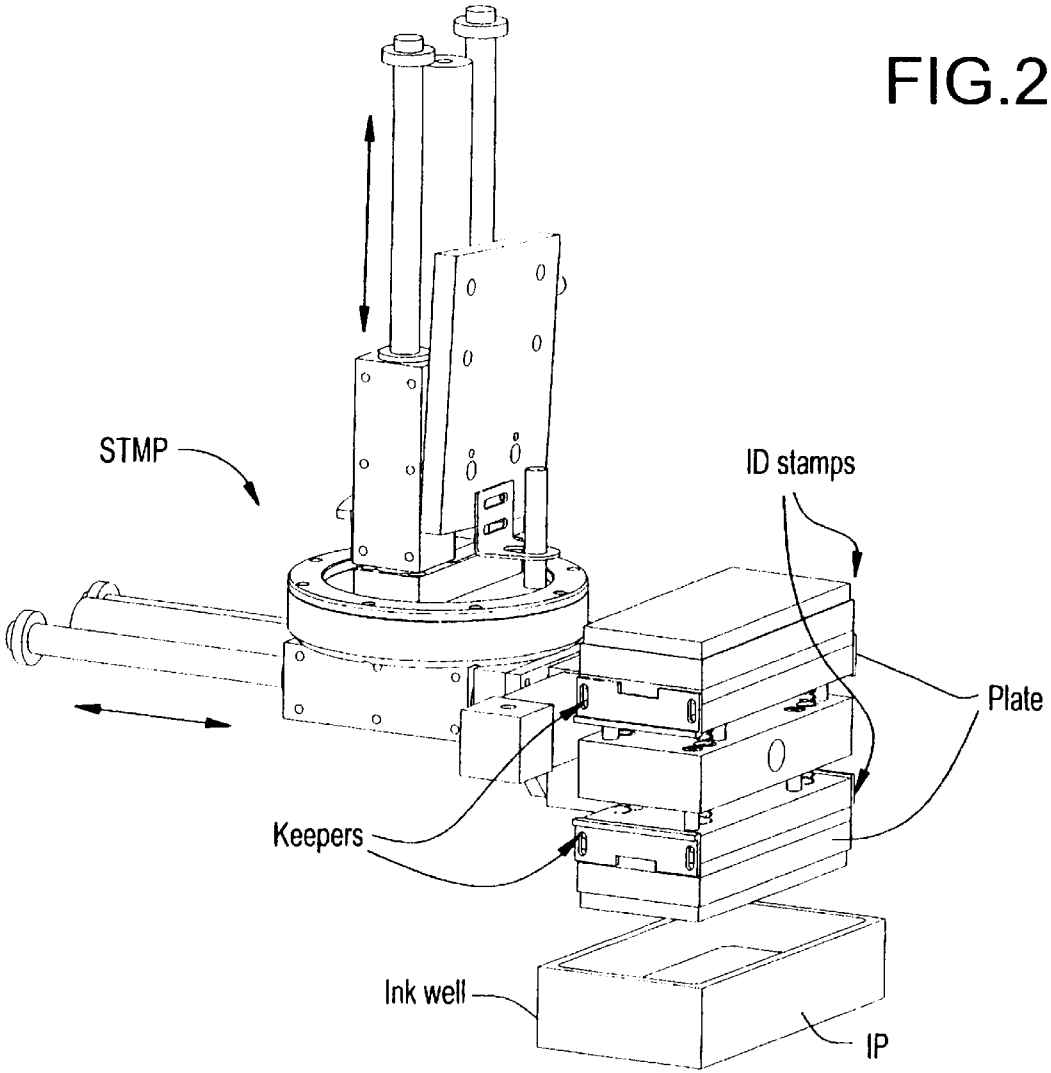
FIG. 23 is a perspective view of the bag stamper and its ink well.

FIG. 23 shows the bag stamper mechanism STMP, which imprints appropriate identification onto the bag which is placed onto the vertical positioner VP, prior to filling. The stamper mechanism is comprised of a stamp plate with interchangeable text plates that are first pressed into the ink pad well IP, then moved over the positioner VP and pressed against the bag about to be filled.

BAG FLAP FOLDING & CLOSING

The fold section mechanism removes the stick from the vertical positioner VP, at which time the open (flap) end of bag B extends beyond the uppermost of the ends therein. The fold section mechanism folds the bag flap over, and seals the flap with a glue iron GI.

FIGS. 26–31 show the components of the fold section mechanism. The fold gripper assembly FG (FIG. 31) can rotate from vertical to horizontal, and can move in and out so as to enter the central area of the fold section, remove a stick from the vertical positioner VP and transport the stick throughout the fold cycle and to the discharge position. A stick height adjuster mechanism (not shown) is simply a vertically operating cylinder located in the center bottom region of the fold section area, with a small platter at its top to engage the under (closed) side of the stick so as to raise the stick to an optimum height for folding.

A support gripper mechanism SG (FIG. 31) is a stationary gripper that loosely surrounds the stick and provides additional stability to the stick during the folding process. An air vacuum tube VT (FIG. 28) enters the mouth of and collapses the bag B by evacuating it to allow for a clean fold. A fold fork FF (FIG. 28) is mounted to be moved against the flap end of the bag to crease the bag just above the height of the contained ends, i.e. to loosely define the flap.

The upper or flap gripper FLG (FIG. 26, 27 & 29) is fitted with rollers at the end of it gripper fingers (shown open) so the fingers can clasp the flap of the bag between them and rotate the flap over the top of the stick to close it. Air jets AJ (FIG. 29) assist the vacuum tube VT in correctly collapsing the bag at the flap end, by impinging on and forcing the side pleats of the bag inward.

A fold plate (FIGS. 27–29) FP moves within the flap gripper fingers as they pull free of the flap, and holds the flap in position for sealing. The glue iron GI moves, through the window in plate FP, against the side of the flap pulled over the upper end of the stick and melts the pre-applied sealant. The base of the fold plate supports includes a tamper TMP which holds the flap in place while the adhesive bonds.

Figure 30:
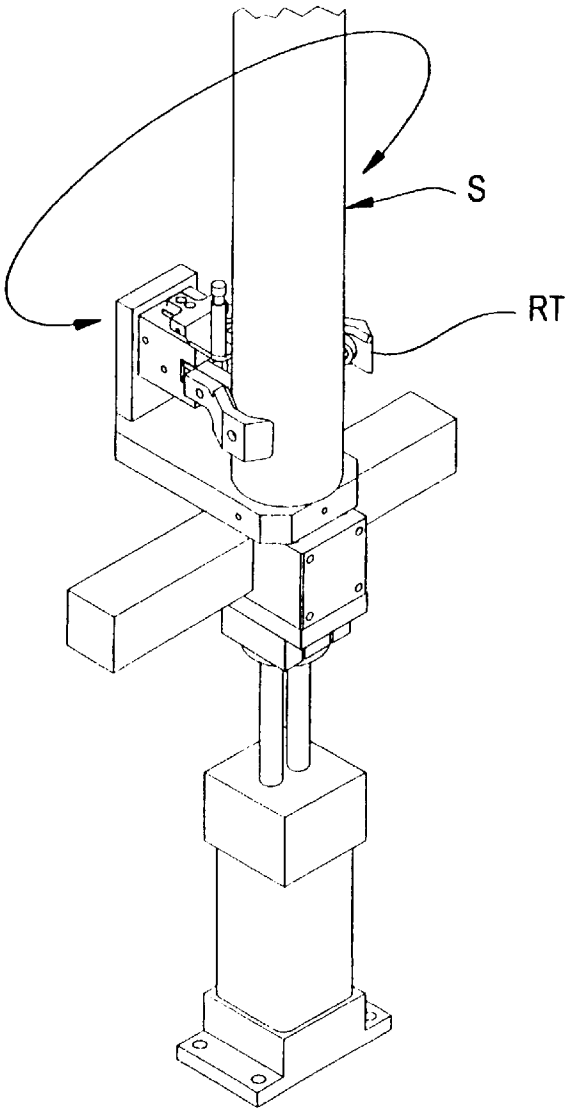
FIG. 30 shows the rotate grippers which spin the stick to orient the fold flap properly.
Figure 31:
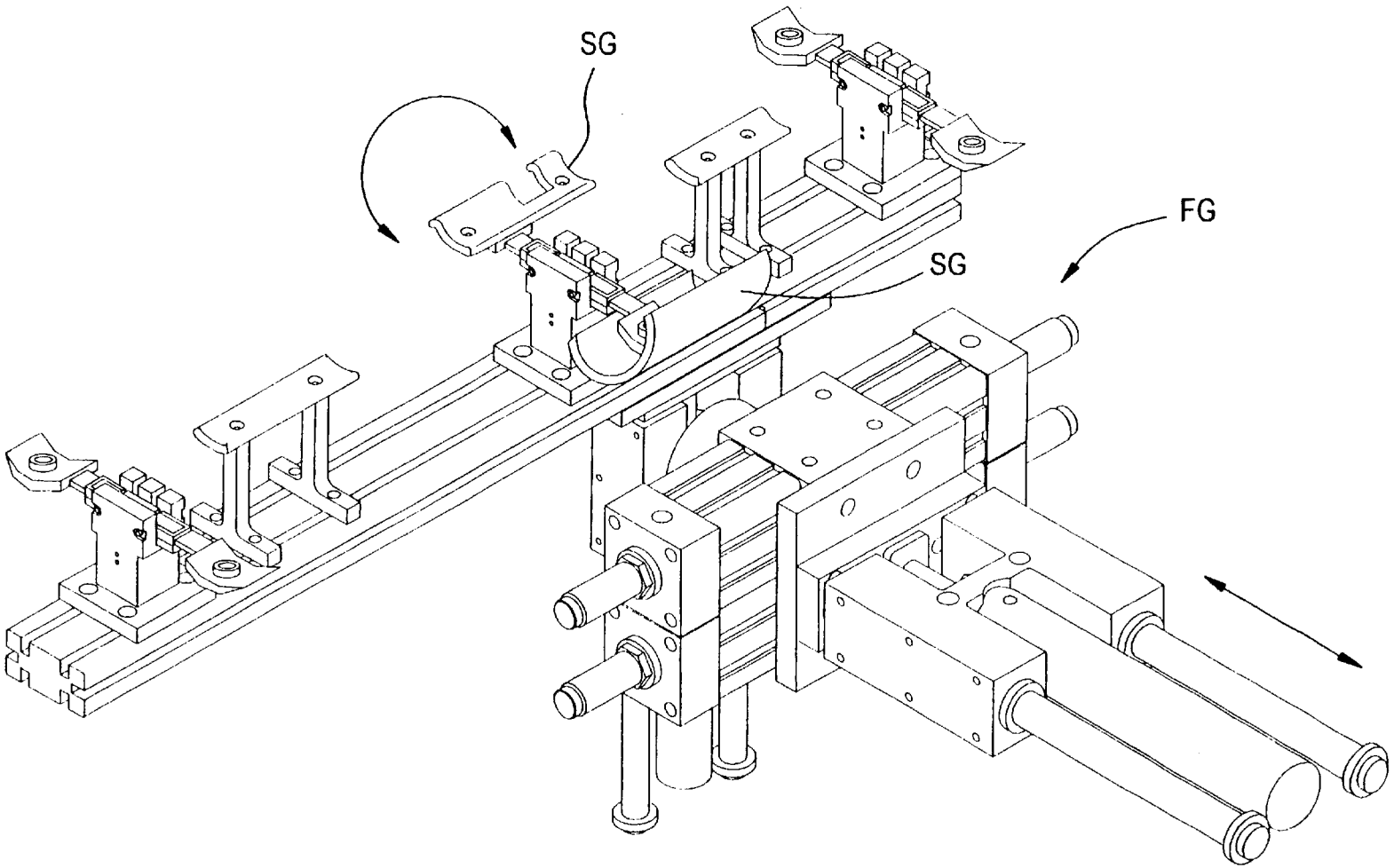
FIG. 31 is a perspective view of the stick discharge grippers which remove a stick from the vertical positioner, transport it through the fold operation, rotate the stick to orient the flap, and then rotate the stick to a horizontal position and transfer the stick into the palletizer.

FIG. 30 shows the stick flap orientation mechanism which sets a new level for the stick within the fold grippers FG and also rotates the stick about its longitudinal axis to properly orient the flap on the sealed stick. After that, the mechanism DG rotates the stick back to a horizontal orientation, from whence it transfers into the staging area of the palletizer.

OPERATING SEQUENCE

Once the bagger apparatus is readied for operation, the controller operates it according to the following sequence.

Figure 15:
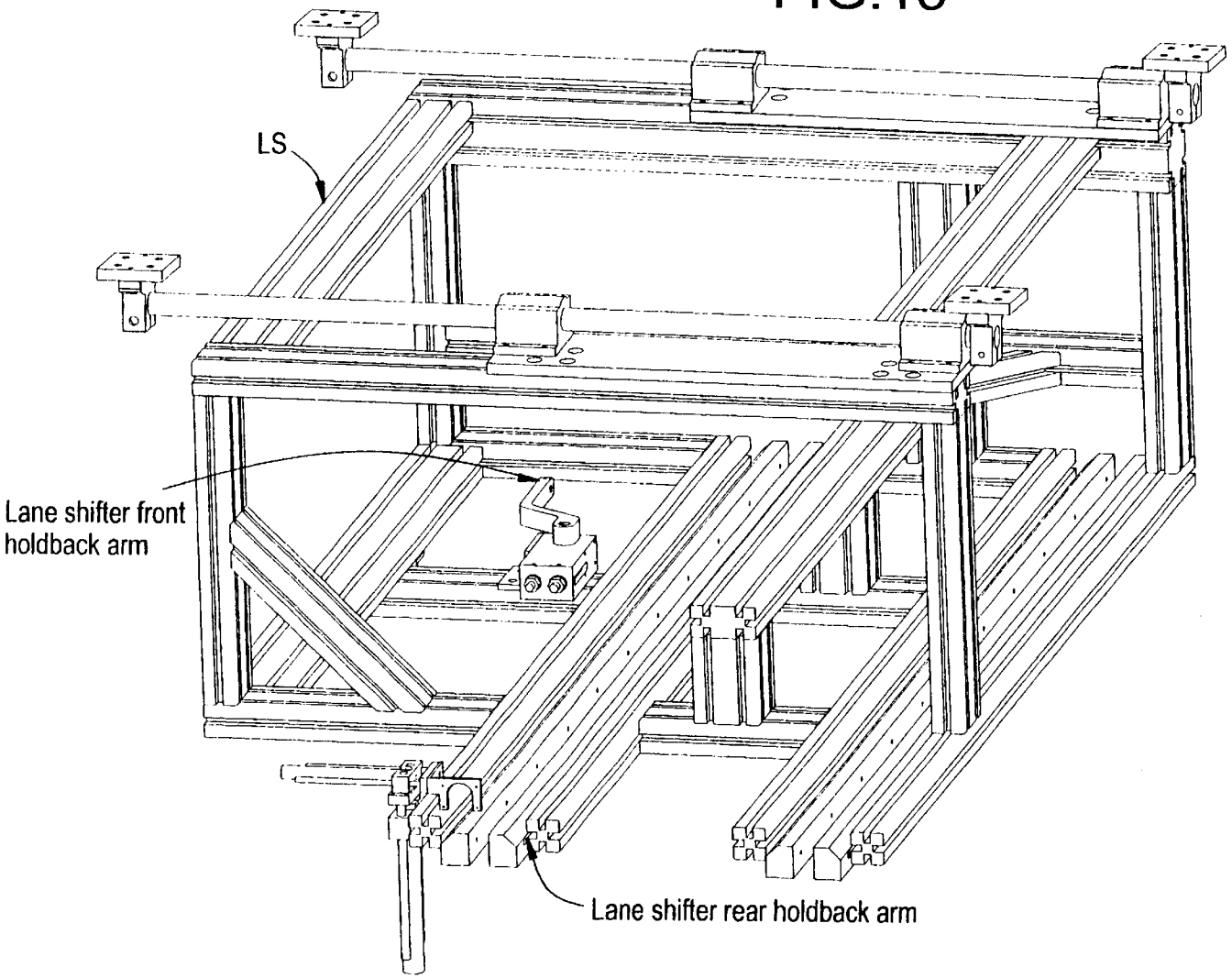
FIG. 15 shows the hold back arms for the lane shifter in the dual lane bagger.
Figure 16:
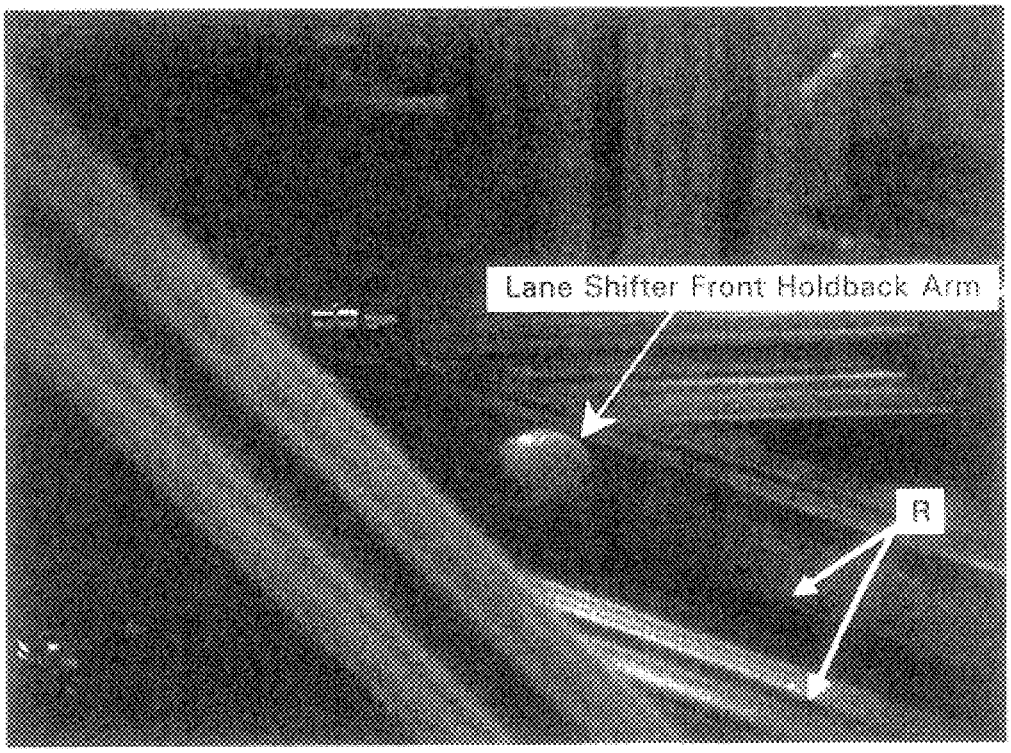
FIGS. 16 and 17 the front and rear hold back arms for the lane shifter outer lane.
Figure 17:
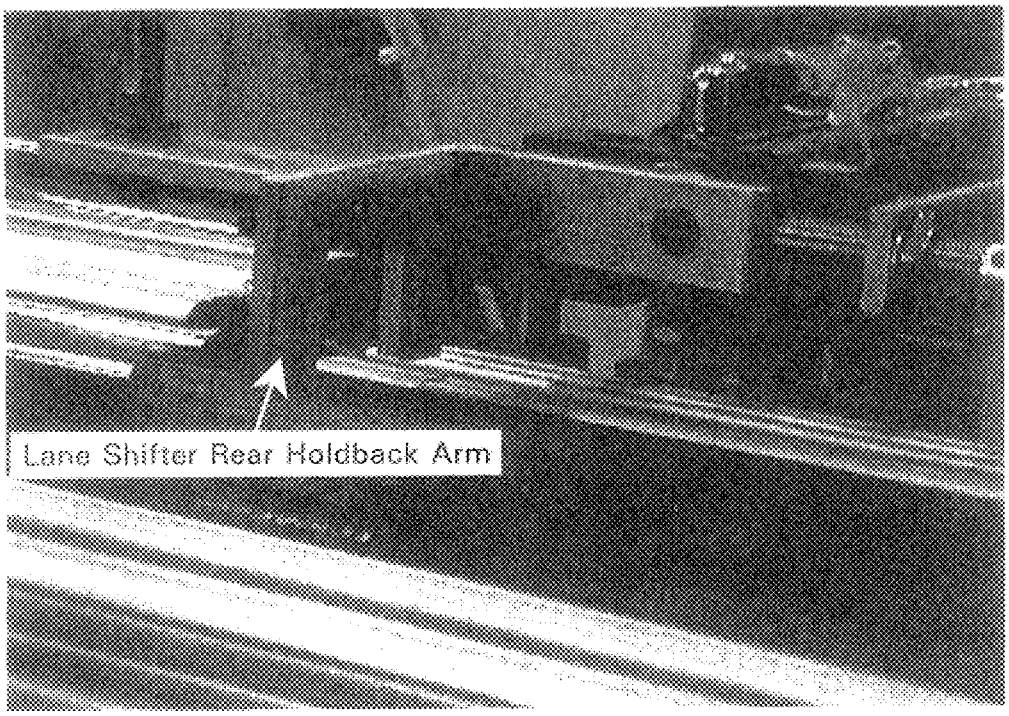
Figure 18:
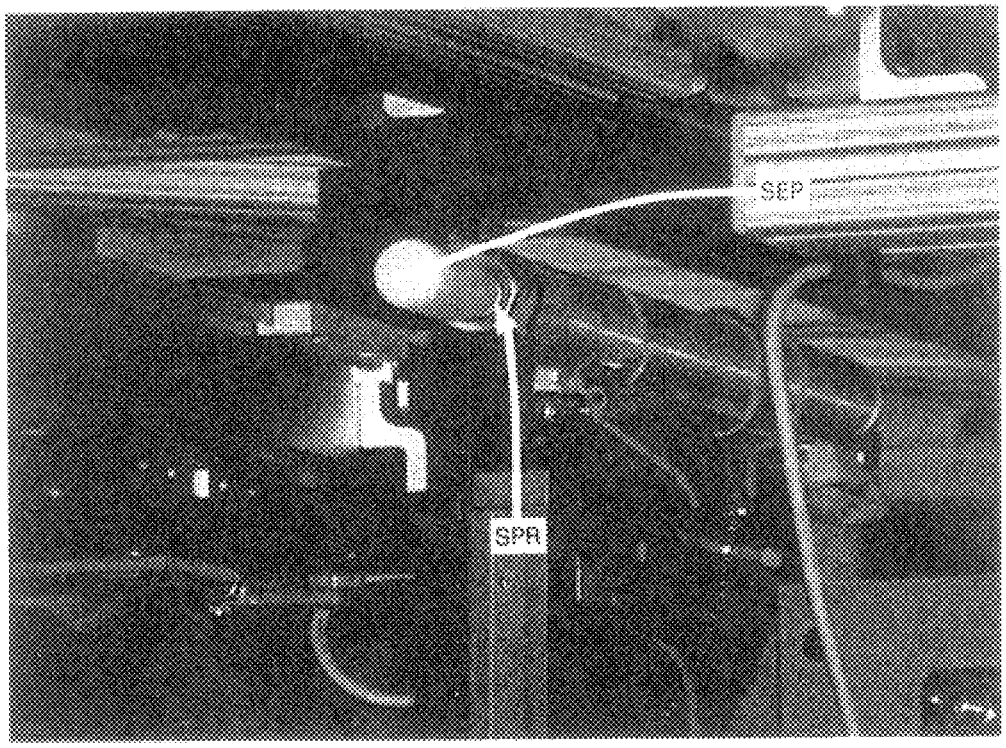
FIG. 18 is a pictorial view of the servo controlled end pusher.

1. Ends feed in through the End Feed Unit and the Counter/Splitter begins counting.
2. The initial hold back HB-1 retains the ends that are being counted.
3. The bag transport head BTH moves over the bag hopper BH-S in the payoff position, lifts a single bag using the four vacuum cups, and places the bag on the vertical positioner VP.
4. The bag open vacuum turns on to hold the bag on the vertical positioner VP.
5. The stamper re-inks, moves over the empty bag, stamps it with the pre-selected identification information, then retracts to its home position.
6. The second hold back HB-2 replaces the initial hold back HB-1 retaining the ends.
7. The preset end count is reached, and the counter/splitter C/S splits the ends to separate the stick of ends.
8. The stick pusher SF pushes the stick of lids into the lane shifter mechanism LS, and the front lane shifter hold back arm, replaces hold back HB-2 retaining the ends. (The lane shifter position on the single lane bagger apparatus is merely an extension of the in-feed rails; it does not have front or rear lane shifter hold back arms; its function is to provide for possible expansion of the system by adding a dual lane bagger apparatus in place of the single lane one.)
9. The rear lane shifter hold back arm (FIG. 15) clamps the stick of ends against the front lane shifter hold back arm.
10. The bag open grippers BOC (FIGS. 20 & 24) grasp the top side of the bag, lift it, and hold it while the vertical positioner vacuum cup holds down the bottom side of the bag.
11. Horn guide HG (FIG. 25) inserts into the open end of the bag.
12. A short burst of air is blown into the bag to fully open it.
13. The lane shifter 65 aligns the counted stick of ends with the vertical positioner and the open bag.
14. The front and rear lane shifter hold back arms (FIG. 15) release the stick and the servo controlled pusher SEP pushes the ends into the open bag, then retracts.
15. The vertical positioner stick clamps VFL rotate in and clamp the filled bag.
16. The bag open grippers release the flap end of the bag, and the bag transport head return to its home-position.
17. Vertical positioner VP rotates the stick from the horizontal to the vertical position.
18. The fold mechanism (discharge) grippers FG remove the stick from the vertical positioner.
19. The stick height adjust detects the height of the stick and raises it to the optimum height for folding.
20. The vacuum tube VT is inserted into the bag.
21. The air jets force the side pleats of the bag flap inward.
22. The vacuum to VT is turned on.
23. The upper or flap gripper FLG moves in and grasps the top of the bag.
24. The fold fork FF moves in and down, and creases the base of the fold.
25. The Vacuum Tube raises out of the bag and retracts.
26. The flap gripper FLG rotates the top of the bag over, creating the flap.
27. The fold plate FP lowers over the stick, removing the flap from the gripper.
28. The fold fork FF retracts.
29. The glue iron enters the opening in the side of the fold plate FP and melts the pre-applied adhesive.
30. The Glue Iron retracts.
31. The tamper TMP enters the opening in the side of the fold plate FP and applies pressure while the adhesive cures.

32. The tamper retracts.
33. The fold plate FP retracts
34. The fold mechanism (Discharge)Grippers FG retract to the Pick & Place handoff position.
35. The rotate grippers RT rotate the stick 180° about its axis.
36. The stick is then rotated to a horizontal orientation.

While the methods and apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. Apparatus for forming uniform sticks of can ends, comprising means for assembling a predetermined number of ends into a stick away from an incoming supply stream thereof, means for holding a bag with an open end facing the stick of ends, means for pushing the stick of ends entirely into the bag, means for driving said pushing means including a servo motor and a controller for said servo motor capable of varying rates of acceleration and deceleration thereof to cause said pushing means to move the stick of ends at rates which avoid compression and expansion of the stick of ends as they are loaded into the bag, means for forming a flap from the open end of the bag and folding the flap across the open end to close the bag end and secure the can ends loaded therein, and means for securing the flap to the remainder of the bag.

2. Apparatus as defined in claim 1, wherein said controller operates said servo motor according to the equation $$\frac{1}{2}\text{ Max. Acceleration} \leqq \text{Average Acceleration} < \text{Max. Acceleration.}$$

3. Apparatus as defined in claim 1, wherein said means for holding a bag includes a positioner which includes a ramp and means for holding a bag on said ramp, means for moving said ramp between a generally horizontal position to receive sticks of can ends pushed into the bag and a vertical position in which a closing flap may be formed from the open end of the bag to secure the stick of ends.

4. Apparatus as defined in claim 3 wherein the means for forming a flap includes means to set the height of the bagged stick so the flap is formed closely upon the contained stick of ends.

5. Apparatus as defined in claim 4, wherein the means for forming a flap includes means to adhere the completed flap to a side of the bag.

6. Apparatus as defined in claim 3, further including a hopper means providing a supply of folded bags for individual transfer to said ramp.

7. Apparatus as defined in claim 6, wherein said hopper is comprised of a pair of like trays for containing supplies of bags, a bag transfer device for moving single bags from one of said trays to the ramp, the other tray being in a position for replenishment of the supply of bags.

8. Apparatus as defined in claim 7, wherein said hopper is rotatable to present the trays alternatively in a payoff position and in a reloading position.

9. Apparatus as defined in claim 1, wherein the means for forming a flap including a means to present the resultant stick with its flap in a predetermined orientation.

10. Apparatus as defined in claim 1 further comprising means for moving the bag without disturbing the ends therein into a generally vertical orientation with the open end thereof at the top.

11. The method of forming uniform sticks of can ends comprising a) assembling a predetermined number of ends into a stick away from an incoming supply stream thereof, b) holding a bag with an open end facing the stick of ends, c) pushing the suck of ends entirely into the bag by varying rates of acceleration and deceleration of a servo motor to cause the stick of ends to move at rates which avoid compression and expansion of the stick of ends as the ends are loaded into the bag, d) forming a flap from the open end of the bag and folding the flap across the open end to close the bag end and secure the stick of ends loaded therein, and e) securing the flap to the remainder of the bag.

12. The method as defined in claim 11 wherein the bag moving step includes orienting the bag into a generally vertical orientation with the open end thereof at the top.

* * * * *